US007464696B2

(12) United States Patent
Furusawa et al.

(10) Patent No.: US 7,464,696 B2
(45) Date of Patent: Dec. 16, 2008

(54) FUEL SUPPLY APPARATUS

(75) Inventors: Shinya Furusawa, Nagoya (JP); Terutoshi Tomoda, Mishima (JP); Mitsuto Sakai, Toyota (JP); Daichi Yamazaki, Toyota (JP); Tomihisa Tsuchiya, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 197 days.

(21) Appl. No.: 11/272,973

(22) Filed: Nov. 15, 2005

(65) Prior Publication Data

US 2006/0102149 A1 May 18, 2006

(30) Foreign Application Priority Data

Nov. 18, 2004 (JP) ..... 2004-334444

(51) Int. Cl.
*F02D 41/32* (2006.01)
*F02M 69/04* (2006.01)
*F02M 63/02* (2006.01)

(52) U.S. Cl. ..... 123/446

(58) Field of Classification Search ..... 123/446, 123/510

See application file for complete search history.

(56) References Cited

U.S. PATENT DOCUMENTS

2002/0040692 A1 4/2002 LaPointe et al.
2004/0007209 A1 1/2004 Ohtani
2005/0072405 A1 4/2005 Kojima et al.

FOREIGN PATENT DOCUMENTS

| | | |
|---|---|---|
| EP | 1 520 981 A2 | 4/2005 |
| JP | A 7-103048 | 4/1995 |
| JP | A 10-318071 | 12/1998 |
| JP | A 2001-336439 | 12/2001 |
| JP | 2003-503414 | 6/2003 |

*Primary Examiner*—Stephen K. Cronin
*Assistant Examiner*—Arnold Castro
(74) *Attorney, Agent, or Firm*—Oliff & Berridge, PLC

(57) ABSTRACT

An electrically driven type low-pressure fuel pump whose flow rate can be set draws fuel from a fuel tank and discharges it at a prescribed pressure commonly to a low-pressure fuel supply system including intake manifold injectors and a low-pressure delivery pipe and to a high-pressure fuel supply system including in-cylinder injectors, a high-pressure delivery pipe and a high-pressure fuel pump. The discharge flow rate of the low-pressure fuel pump is set based on required supply quantities to the low-pressure fuel supply system and to the high-pressure fuel supply system obtained according to the engine operation conditions. The discharge quantity of the fuel pump in the internal combustion engine can be set as appropriate, and thus, deterioration in fuel efficiency due to excessive flow rate setting and operation failure due to insufficient fuel supply can be prevented, whereby reliability is improved.

16 Claims, 13 Drawing Sheets

FUEL SUPPLY APPARATUS

This nonprovisional application is based on Japanese Patent Application No. 2004-334444 filed with the Japan Patent Office on Nov. 18, 2004, the entire contents of which are hereby incorporated by reference.

BACKGROUND OF THE INVENTION

1. Field of the Invention

The present invention relates to a fuel supply apparatus, and more particularly to a fuel supply apparatus for an internal combustion engine having first fuel injection means (in-cylinder injector) for injecting fuel into a cylinder and second fuel injection means (intake manifold injector) for injecting fuel into an intake manifold or an intake port.

2. Description of the Background Art

A fuel supply apparatus (fuel injection apparatus) provided with an intake manifold injector for injecting fuel into an intake port and an in-cylinder injector for injecting fuel into a cylinder, and controlling the intake manifold injector and the in-cylinder injector in accordance with an operation state to realize fuel injection by a combination of intake manifold injection and in-cylinder injection is known.

In such a fuel supply apparatus, it is necessary to secure a fuel injection pressure from the in-cylinder injector so as to spray the fuel directly into the cylinder. To this end, a configuration is disclosed where fuel is drawn from a fuel tank by a common low-pressure fuel pump and discharged to a high-pressure fuel supply system for the in-cylinder injection and to a low-pressure fuel supply system for the intake manifold injection, and while the fuel discharged from the low-pressure fuel pump is further increased in pressure by a high-pressure fuel pump to supply the pressurized fuel to the in-cylinder injector in the high-pressure fuel supply system, the fuel discharged from the low-pressure fuel pump is injected from the intake manifold injector in the low-pressure fuel supply system (for example, Japanese Patent Laying-Open No. 2001-336439).

The relevant document particularly discloses a technique of setting a ratio between the quantity of the fuel injected into the cylinder and the quantity of the fuel injected into the intake manifold taking account of the particulate state of the fuel injected into the cylinder in an internal combustion engine provided with such a fuel supply apparatus.

SUMMARY OF THE INVENTION

With the configuration of the fuel supply apparatus as disclosed in the above document, however, the low-pressure fuel pump is generally implemented with a pump of an electric motor driven type whose discharge quantity (flow rate) is controllable, and the high-pressure fuel pump is generally implemented with a pump of an engine driven type that is driven by revolution of the internal combustion engine. The quantity of the fuel injected from the intake manifold injector and the quantity of the fuel injected from the in-cylinder injector are controlled separately depending on the operation state of the internal combustion engine.

Therefore, control of the flow-rate of the low-pressure fuel pump supplying the fuel pumped from the fuel tank commonly to the low-pressure fuel supply system and the high-pressure fuel supply system becomes important. For example, if the quantity of the fuel injected from the intake manifold injector is smaller than a required injection quantity due to an insufficient discharge quantity of the low-pressure fuel pump, the air-fuel ratio (A/F) will become lean, thereby causing failure in combustion, decrease of power output, and degradation of exhaust emission property. If the fuel supplied to the high-pressure fuel pump is insufficient, the fuel of an adequate quantity will not flow into a plunger portion constituting the high-pressure fuel pump, thereby causing operation failure due to poor lubrication of the plunger. This leads to a decrease in fuel pressure of the high-pressure fuel system, in which case in-cylinder fuel injection cannot be carried out satisfactorily, possibly making the engine stop.

Meanwhile, if the quantity of the fuel supplied from the low-pressure fuel pump (electric pump) is set too much with the concern of short supply to the low-pressure fuel supply system and the high-pressure fuel supply system, although the above-described problems may be avoided, power consumed by the electric pump will increase, leading to deterioration of fuel efficiency.

The present invention has been made to solve the above-described problems, and an object of the present invention is to provide a fuel supply apparatus for an internal combustion engine having a first fuel injection mechanism (in-cylinder injector) for injecting fuel into a cylinder and a second fuel injection mechanism (intake manifold injector) for injecting fuel into an intake manifold and/or an intake port, which is highly reliable as a discharge quantity (flow rate) of a low-pressure fuel pump supplying fuel commonly to a high-pressure fuel supply system and a low-pressure fuel supply system is optimized to prevent deterioration of fuel efficiency due to setting of excessive flow rate and to avoid operation failure due to insufficient fuel supply.

The present invention provides a fuel supply apparatus for supplying fuel to an internal combustion engine, which includes a first fuel pump, a first fuel supply system, a second fuel supply system, and a discharge quantity calculating portion. The first fuel pump draws fuel from a fuel tank and discharging the fuel at a first pressure. The first fuel supply system includes first fuel injection mechanisms for injecting fuel into the internal combustion engine at the first pressure and a first fuel delivery pipe receiving the fuel discharged from the first fuel pump and delivering the fuel to the first fuel injection mechanisms. The second fuel supply system includes second fuel injection mechanisms for injecting fuel into the internal combustion engine at a second pressure that is higher than the first pressure, a second fuel pump driven by the internal combustion engine and drawing and further pressurizing the fuel discharged from the first fuel pump and discharging the fuel at the second pressure, and a second fuel delivery pipe receiving the fuel discharged from the second fuel pump and delivering the fuel to the second fuel injection mechanisms. The discharge quantity calculating portion obtains required supply quantities to the first and second fuel supply systems, respectively, in accordance with an operation condition of the internal combustion engine, and determines a discharge quantity from the first fuel pump based on the required supply quantities obtained.

In the fuel supply apparatus, the discharge quantity of the first fuel pump (low-pressure fuel pump) supplying fuel commonly to the first fuel supply system (low-pressure fuel supply system) and the second fuel supply system (high-pressure fuel supply system) is set based on the required supply quantities to the first and second fuel supply systems in accordance with the operation condition of the internal combustion engine. Accordingly, it is possible to increase reliability by preventing insufficient fuel supply to the fuel supply systems, and to improve fuel efficiency by preventing an increase in power consumption by the first fuel pump due to excessive fuel supply.

Preferably, in the fuel supply apparatus according to the present invention, the discharge quantity calculating portion includes first through third calculating portions. The first calculating portion calculates the required supply quantity to the first fuel supply system based on at least a fuel injection quantity by the first fuel injection mechanisms and the number of revolutions of the internal combustion engine. The second calculating portion calculates the required supply quantity to the second fuel supply system based on at least the number of revolutions of the internal combustion engine. The third calculating portion determines the discharge quantity from the first fuel pump in accordance with a sum of the required supply quantities calculated by the first and second calculating portions.

In the fuel supply apparatus, the required supply quantities to the fuel supply systems can be calculated appropriately and with ease in accordance with the operation condition of the internal combustion engine.

Still preferably, the fuel supply apparatus according to the present invention further includes a fuel injection control unit. The fuel injection control unit controls a fuel injection ratio between the first fuel injection mechanisms and the second fuel injection mechanisms with respect to a total fuel injection quantity in accordance with an operation state of the internal combustion engine. Further, the first calculating portion calculates the required supply quantity to the first fuel supply system by obtaining the fuel injection quantity of the first fuel injection mechanisms reflecting the fuel injection ratio controlled by the fuel injection control unit.

In the fuel supply apparatus, the required supply quantity to the first fuel supply system (low-pressure fuel supply system) is calculated reflecting the fuel injection ratio (DI ratio) between the first and second fuel injection mechanisms. In this manner, it is possible to appropriately set the flow rate of the first fuel pump (low-pressure fuel pump) in association with the fuel injection ratio according to the operation state. As such, excessive fuel supply by the first fuel pump (low-pressure fuel pump) to the internal combustion engine provided with two kinds of fuel injection mechanisms is prevented appropriately, whereby fuel efficiency is improved.

Still preferably, in the fuel supply apparatus according to the present invention, a plurality of second fuel delivery pipes are provided, and the second fuel injection mechanisms are divided into groups and provided respectively for the plurality of second fuel delivery pipes, and a plurality of second fuel pumps are provided respectively for the second fuel delivery pipes. In each of the second fuel pumps, a plunger in a cylinder is driven to move in a reciprocating manner by a cam that is driven to rotate by the internal combustion engine, and in an intake stroke where the volumetric capacity of a pressurizing chamber delimited by the cylinder and the plunger is increased, the fuel is drawn to the pressurizing chamber from an intake side of the second fuel pump connected to a discharge side of the first fuel pump, and in a discharge stroke where the volumetric capacity of the pressurizing chamber is reduced, the fuel is discharged from the pressurizing chamber to a discharge route during a valve-closed period of a metering valve and the fuel reversely flows from the pressurizing chamber to the intake side during a valve-opening period of the metering valve. The fuel supply apparatus further includes a connecting path and a flow rate regulating unit. The connecting path connects the intake sides of the plurality of second fuel pumps with each other. The flow rate regulating unit is provided on a fuel route between the connecting path and the first fuel delivery pipe.

In the fuel supply apparatus, the connecting path is provided between the intake sides of the plurality of second fuel pumps (high-pressure fuel pumps), and the flow rate regulating unit is provided between the connecting path and the first fuel delivery pipe. In this manner, the fuel reversely flowing from the second fuel pump in the discharge stroke from its pressurizing chamber is prevented from causing variation in pressure in the first fuel supply system (low-pressure fuel supply system). As a result, variation in fuel pressure in the first fuel delivery pipe is restricted, and fuel injection from the first fuel injection mechanisms (intake manifold injectors) is stabilized, whereby the power output of the internal combustion engine is stabilized.

Particularly in this configuration, the second fuel pumps having their intake sides connected to each other via the connecting path are arranged such that one of the second fuel pumps operates in the intake stroke when the other of the second fuel pumps operates in the discharge stroke.

In the fuel supply apparatus, the second fuel pumps (high-pressure fuel pumps) having their intake sides connected via the connecting path are made to operate in opposite phases from each other. Thus, the fuel discharged back from one of the high-pressure fuel pumps in the discharge stroke can be used for the fuel drawn to the other high-pressure fuel pump that is in the intake stroke. The fuel supply quantity from the first fuel pump (low-pressure fuel pump) can be reduced by the quantity of the fuel discharged back, and thus, fuel efficiency can further be improved with the flow rate of the low-pressure fuel pump restricted.

Alternatively, in the fuel supply apparatus according to the present invention, in the second fuel pump, a plunger in a cylinder is driven to move in a reciprocating manner by a cam that is driven to rotate by the internal combustion engine, and in an intake stroke where the volumetric capacity of a pressurizing chamber delimited by the cylinder and the plunger is increased, the fuel is drawn to the pressurizing chamber from an intake side of the second fuel pump that is connected to a discharge side of the first fuel pump via a branch point, and in a discharge stroke where the volumetric capacity of the pressurizing chamber is reduced, the fuel is discharged from the pressurizing chamber to a discharge route during a valve-closed period of a metering valve and the fuel reversely flows from the pressurizing chamber to the intake side during a valve-opening period of the metering valve. The fuel supply apparatus further includes a fuel discharge-back unit for guiding the fuel reversely flowing from the pressurizing chamber to the intake side in the second fuel pump in the discharge stroke to a fuel discharge-back position provided in the first fuel supply system. Particularly, the branch point is arranged at a position farther from the fuel tank than at least the fuel discharge-back position. It is preferable that the fuel discharge-back position is provided immediately close to the outlet of the fuel tank so as to secure a sufficient route length between the fuel discharge-back position and the first fuel delivery pipe.

In the fuel supply apparatus, the fuel reversely flowing from the second fuel pump in the discharge stroke from its pressurizing chamber is guided to the position that is farther than at least the branch point of the fuel intake path to the second fuel pump. This can prevent the reversely flowing fuel from causing variation in pressure in the first fuel supply system (low-pressure fuel supply system). As a result, variation in fuel pressure in the first fuel delivery pipe is restricted, and fuel injection from the first fuel injection mechanisms (intake manifold injectors) is stabilized, resulting in stabilization of the power output of the internal combustion engine.

Still preferably, in the fuel supply apparatus according to the present invention, in the second fuel pump, a plunger in a cylinder is driven to move in a reciprocating manner by a cam that is driven to rotate by the internal combustion engine, and in an intake stroke where the volumetric capacity of a pressurizing chamber delimited by the cylinder and the plunger is increased, the fuel is drawn to the pressurizing chamber from an intake side of the second fuel pump connected to a discharge side of the first fuel pump, and in a discharge stroke where the volumetric capacity of the pressurizing chamber is reduced, the pressurized fuel is discharged from the pressurizing chamber to a discharge route. The fuel supply apparatus further includes a fuel return unit that is actuated when a fuel pressure in the second fuel delivery pipe exceeds a prescribed level, to form a fuel return route from the second fuel delivery pipe to the fuel tank.

The fuel supply apparatus employs the high-pressure fuel pump in which there is no fuel discharged back to the first fuel supply system (low-pressure fuel supply system) from the second fuel pump (high-pressure fuel pump). This prevents occurrence of variation in fuel pressure in the low-pressure fuel supply system. Accordingly, fuel injection from the first fuel injection mechanisms (intake manifold injectors) is stabilized, and thus, the power output of the internal combustion engine is stabilized. Further, the high-pressure fuel pump is simplified in configuration, since a metering valve requiring open/close control in accordance with the discharge quantity is not provided.

Alternatively, in the fuel supply apparatus according to the present invention, a plurality of first fuel delivery pipes are provided, the first fuel injection mechanisms are divided into groups and provided respectively for the plurality of first fuel delivery pipes, and the first fuel pump is commonly provided for the plurality of first fuel delivery pipes. The fuel supply apparatus further includes pressure adjusting devices provided respectively for the plurality of first fuel delivery pipes.

In the fuel supply apparatus, in the configuration where the first fuel supply system (low-pressure fuel supply system) and the second fuel supply system (high-pressure fuel supply system) are both provide and a plurality of first fuel delivery pipes are provide respectively for the banks or the like, fuel pressure can be stabilized in each of the first fuel delivery pipes. Accordingly, fuel injection from the first fuel injection mechanisms (intake manifold injectors) and, hence, the power output of the internal combustion engine can be stabilized.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
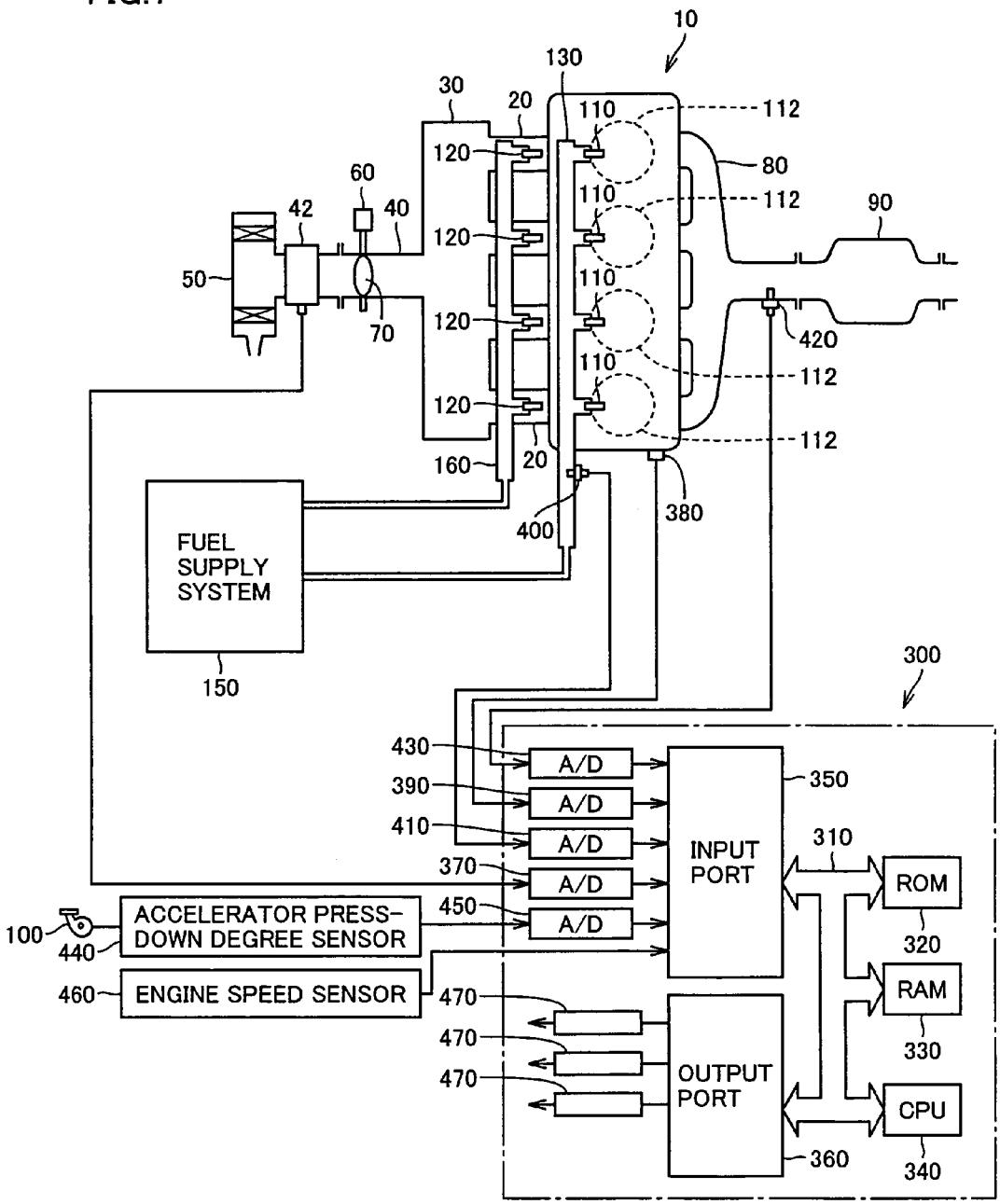
FIG. 1 schematically shows a configuration of an engine system incorporating a fuel supply apparatus according to embodiments of the present invention.

Hereinafter, embodiments of the present invention will be described in detail with reference to the drawings. In the drawings, the same or corresponding portions have the same reference characters allotted, and detailed description thereof will not be repeated where appropriate.

First Embodiment

FIG. 1 schematically shows an engine system incorporating a fuel supply apparatus according to embodiments of the present invention. Although an in-line 4-cylinder gasoline engine is shown in FIG. 1, application of the present invention is not restricted to the engine shown.

As shown in FIG. 1, the engine (internal combustion engine) 10 includes four cylinders 112, which are connected via corresponding intake manifolds 20 to a common surge tank 30. Surge tank 30 is connected via an intake duct 40 to an air cleaner 50. In intake duct 40, an airflow meter 42 and a throttle valve 70, which is driven by an electric motor 60, are disposed. Throttle valve 70 has its degree of opening controlled based on an output signal of an engine ECU (Electronic Control Unit) 300, independently from an accelerator pedal 100. Cylinders 112 are connected to a common exhaust manifold 80, which is in turn connected to a three-way catalytic converter 90.

For each cylinder 112, an in-cylinder injector 110 for injecting fuel into the cylinder and an intake manifold injector 120 for injecting fuel into an intake port and/or an intake manifold are provided.

Injectors 110, 120 are controlled based on output signals of engine ECU 300. In-cylinder injectors 110 are connected to a common fuel delivery pipe (hereinafter, also referred to as "high-pressure delivery pipe") 130, and intake manifold injectors 120 are connected to a common fuel delivery pipe (hereinafter, also referred to as "low-pressure delivery pipe") 160. Fuel supply to fuel delivery pipes 130, 160 is carried out by a fuel supply system 150, which will be described later in detail.

Engine ECU 300 is configured with a digital computer, which includes a ROM (Read Only Memory) 320, a RAM (Random Access Memory) 330, a CPU (Central Processing Unit) 340, an input port 350, and an output port 360, which are connected to each other via a bidirectional bus 310.

Airflow meter 42 generates an output voltage that is proportional to an intake air quantity, and the output voltage of airflow meter 42 is input via an A/D converter 370 to input port 350. A coolant temperature sensor 380 is attached to engine 10, which generates an output voltage proportional to an engine coolant temperature. The output voltage of coolant temperature sensor 380 is input via an A/D converter 390 to input port 350.

A fuel pressure sensor 400 is attached to high-pressure delivery pipe 130, which generates an output voltage proportional to a fuel pressure in high-pressure delivery pipe 130. The output voltage of fuel pressure sensor 400 is input via an A/D converter 410 to input port 350. An air-fuel ratio sensor 420 is attached to exhaust manifold 80 located upstream of three-way catalytic converter 90. Air-fuel ratio sensor 420 generates an output voltage proportional to an oxygen concentration in the exhaust gas, and the output voltage of air-fuel ratio sensor 420 is input via an A/D converter 430 to input port 350.

Air-fuel ratio sensor 420 in the engine system of the present embodiment is a full-range air-fuel ratio sensor (linear air-fuel ratio sensor) that generates an output voltage proportional to an air-fuel ratio of the air-fuel mixture burned in engine 10. As air-fuel ratio sensor 420, an $O_2$ sensor may be used which detects, in an on/off manner, whether the air-fuel ratio of the mixture burned in engine 10 is rich or lean with respect to a theoretical air-fuel ratio.

Accelerator pedal 100 is connected to an accelerator press-down degree sensor 440 that generates an output voltage proportional to the degree of press-down of accelerator pedal 100. The output voltage of accelerator press-down degree sensor 440 is input via an A/D converter 450 to input port 350. An engine speed sensor 460 generating an output pulse representing the engine speed is connected to input port 350. ROM 320 of engine ECU 300 prestores, in the form of a map, values of fuel injection quantity that are set corresponding to operation states based on the engine load factor and the engine speed obtained by the above-described accelerator press-down degree sensor 440 and engine speed sensor 460, respectively, and the correction values based on the engine coolant temperature.

Engine ECU 300 generates various control signals for controlling the overall operations of the engine system based on signals from the respective sensors by executing a prescribed program. The control signals are transmitted to the devices and circuits constituting the engine system via output port 360 and drive circuits 470.

Figure 2:
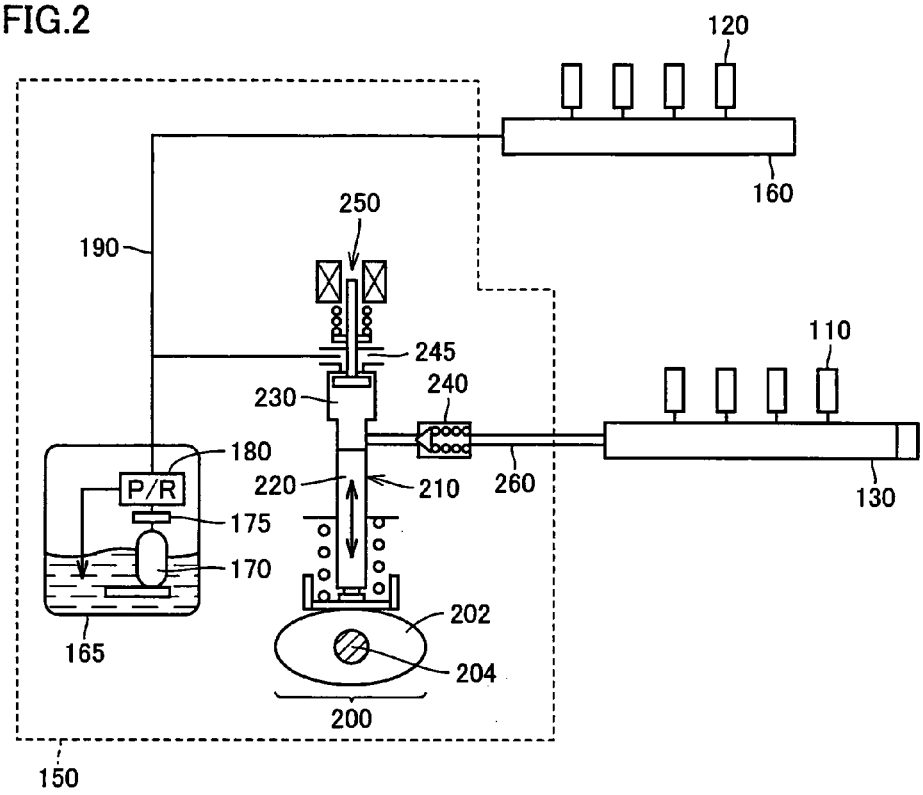
FIG. 2 is a block diagram illustrating a configuration of the fuel supply system shown in FIG. 1.

FIG. 2 is a block diagram illustrating the configuration of fuel supply system 150 shown in FIG. 1.

In FIG. 2, the portions other than in-cylinder injectors 110, high-pressure delivery pipe 130, intake manifold injectors 120 and low-pressure delivery pipe 160 correspond to the fuel supply system 150 of FIG. 1.

Low-pressure fuel pump 170 draws fuel from a fuel tank 165, and discharges it at a prescribed pressure (low-pressure set value). The fuel discharged from low-pressure fuel pump 170 is delivered via a fuel filter 175 and a fuel pressure regulator 180 to a low-pressure fuel path 190. Fuel pressure regulator 180 is opened when the fuel pressure in the low-pressure system begins to increase, to form a route through which the fuel in low-pressure fuel path 190 in the vicinity of fuel pressure regulator 180, i.e., the fuel having just been pumped by low-pressure fuel pump 170, is returned to fuel tank 165. This can maintain the fuel pressure in low-pressure fuel path 190 at a prescribed level. Further, the fuel returned to fuel tank 165 is the one having just been pumped from fuel tank 165, which prevents a temperature increase in fuel tank 165.

High-pressure fuel pump 200 is attached to a cylinder head (not shown). In high-pressure fuel pump 200, a plunger 220 within a pump cylinder 210 is driven in a reciprocating manner by rotation of a cam 202 for the pump that is provided at a camshaft 204 of an intake valve (not shown) or an exhaust valve (not shown) of engine 10. High-pressure fuel pump 200 further includes a high-pressure pump chamber 230 corresponding to a "pressurizing chamber" delimited by pump cylinder 210 and plunger 220, a gallery 245 connected to low-pressure fuel path 190, and an electromagnetic spill valve 250 serving as a "metering valve". Electromagnetic spill valve 250 is a valve that controls connection/disconnection between gallery 245 and high-pressure pump chamber 230.

The discharge side of high-pressure fuel pump 200 is connected via a high-pressure fuel path 260 to a high-pressure delivery pipe 130 that delivers fuel to in-cylinder injectors 110. High-pressure fuel path 260 is provided with a check valve 240 that suppresses reverse flow of the fuel from fuel delivery pipe 130 toward high-pressure fuel pump 200. Further, low-pressure fuel pump 170 provided in fuel tank 165 is connected to the intake side of high-pressure fuel pump 200 via low-pressure fuel path 190.

Figure 3:
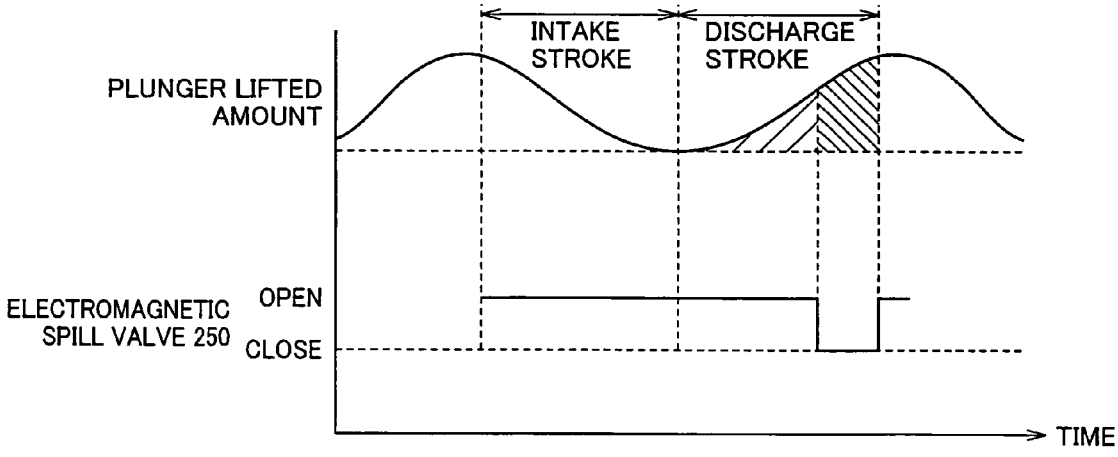
FIG. 3 is a conceptual diagram illustrating an operation of the high-pressure fuel pump shown in FIG. 2.

Referring to FIG. 3, in the intake stroke where the lifted amount of plunger 220 along with the rotation of cam 202 for the pump decreases, the volumetric capacity of high-pressure pump chamber 230 increases with the reciprocating motion of plunger 220. In the intake stroke, electromagnetic spill valve 250 is maintained in the open state.

Referring again to FIG. 2, during the valve-opening period of electromagnetic spill valve 250, gallery 245 is in communication with high-pressure pump chamber 230, so that the fuel is drawn from low-pressure fuel path 190 via gallery 245 into high-pressure pump chamber 230 in the intake stroke.

Referring again to FIG. 3, in the discharge stroke where the lifted amount of plunger 220 by rotation of cam 202 for the pump increases, the volumetric capacity of high-pressure pump chamber 230 decreases with the reciprocating motion of plunger 220. In the discharge stroke, engine ECU 300 controls opening/closing of electromagnetic spill valve 250.

Referring again to FIG. 2, during the valve-opening period of electromagnetic spill valve 250 in the discharge stroke, gallery 245 is in communication with high-pressure pump chamber 230. Thus, the fuel drawn into high-pressure pump chamber 230 overflows to the side of low-pressure fuel path 190 via gallery 245. That is, the fuel is discharged back toward low-pressure fuel path 190 via gallery 245, rather than being delivered via high-pressure fuel path 260 to fuel delivery pipe 130.

Meanwhile, during the valve-closed period of electromagnetic spill valve 250, gallery 245 is not in communication with high-pressure pump chamber 230. Thus, the fuel pressurized in the discharge stroke is delivered via high-pressure fuel path 260 toward fuel delivery pipe 130, rather than reversely flowing into gallery 245.

Engine ECU 300 controls the opening/closing timing of electromagnetic spill valve 250 by referring to the fuel pressure detected by fuel pressure sensor 400 and the fuel injection quantity controlled by the ECU. As such, engine ECU 300 can control the quantity of the fuel pressurized at high-pressure fuel pump 200 and delivered to high-pressure delivery pipe 130, to thereby adjust the fuel pressure within high-pressure delivery pipe 130 to a required level.

As described above, in the fuel supply system shown in FIG. 2, low-pressure fuel pump (feed pump) 170 commonly supplies fuel to the "low-pressure fuel supply system" configured with intake manifold injectors 120 and low-pressure delivery pipe 160, and to the "high-pressure fuel supply system" configured with in-cylinder injectors 110, high-pressure delivery pipe 130 and high-pressure fuel pump 200. Low-pressure fuel pump 170 is of an electrically driven type, as described above, with its discharge quantity (flow rate) controllable by engine ECU 300.

Therefore, in the fuel supply apparatus according to the first embodiment of the present invention, flow rate setting control of the low-pressure fuel pump as shown in the following is carried out to enable both the fuel supply of a required quantity to each of the low-pressure fuel supply system and the high-pressure fuel supply system and the prevention of deterioration of fuel efficiency due to setting of excessive discharge flow rate.

Figure 4:
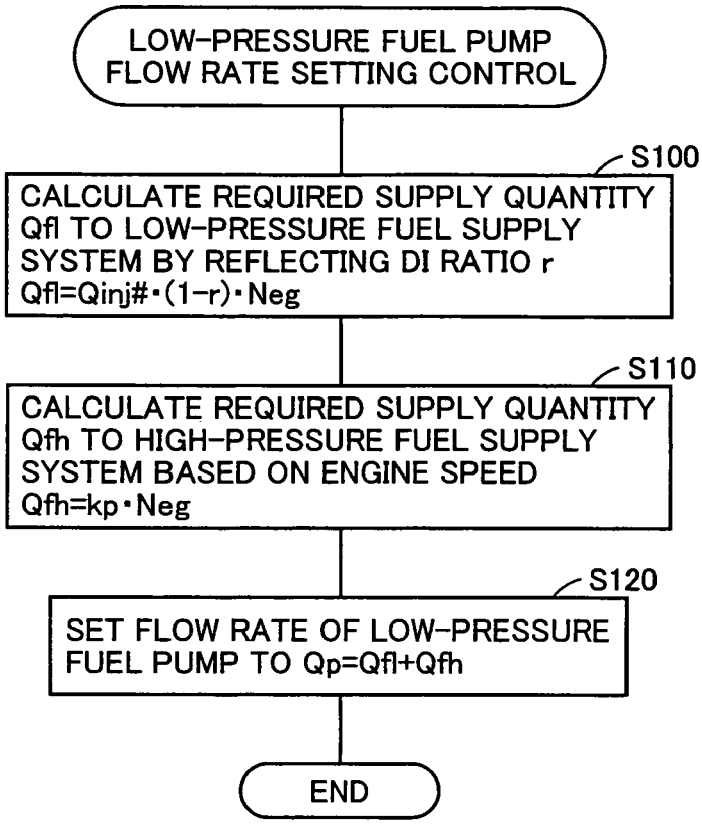
FIG. 4 is a flowchart illustrating control for setting flow rate of a low-pressure fuel pump according to a first embodiment of the present invention.

Referring to FIG. 4, in the flow rate setting control of the low-pressure fuel pump according to the first embodiment of the present invention, firstly, a required supply quantity Qfl to the low-pressure fuel supply system is calculated based on a prescribed expression (1) (step S100).

$$Qfl=Qinj\#\cdot(1-r)\cdot\mathrm{Neg} \quad (1)$$

In expression (1), Qinj# represents a total fuel injection quantity obtained by engine ECU 300 in accordance with the operation state based on the engine load factor and the engine speed, and Neg represents the number of revolutions (engine speed) of engine 10.

Further, r represents a DI (direct injection) ratio indicating a fuel injection ratio between in-cylinder injector 110 and intake manifold injector 120, specifically indicating a ratio of the quantity of the fuel injected via in-cylinder injector 1 10 with respect to a total fuel injection quantity. "DI ratio r=100%" means that fuel is injected only from in-cylinder injector 110, and "DI ratio r=0%" means that fuel is injected only from intake manifold injector 120. "DI ratio r≠0%", "DI ratio r≠100%", and "0%<DI ratio r<100%" each mean that fuel injection is carried out using both in-cylinder injector 110 and intake manifold injector 120.

Engine ECU 300 determines DI ratio r in accordance with the engine speed and the load factor of engine 10 in a normal operation state. Generally, in-cylinder injector 110 contributes to an increase in output performance, while intake manifold injector 120 contributes to homogeneity of the air-fuel mixture. These two types of injectors having such different characteristics are used in accordance with the engine speed and the load factor of the internal combustion engine, such that homogeneous combustion is carried out when the internal combustion engine is in a normal operation state (for example, it can be said that the catalyst warm-up period at idle is an example of an abnormal operation state other than the normal operation state). Preferable setting of the DI ratio will be explained later in detail.

Figure 5:
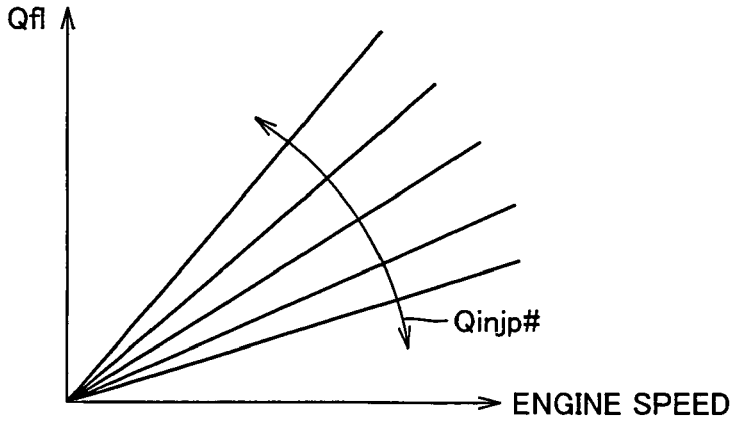
FIG. 5 is a conceptual diagram illustrating an expression for calculating a required supply quantity to a low-pressure fuel supply system.

As shown in FIG. 5, required supply quantity Qfl at the low-pressure fuel supply system according to expression (1) changes in accordance with the engine speed and a low-pressure fuel injection quantity Qinjp#. Low-pressure fuel injection quantity Qinjp# is represented by the following expression (2) using total fuel injection quantity Qinj# and DI ratio r described above.

$$Qinjp\#=Qinj\#\cdot(1-r) \quad (2)$$

As such, required supply quantity Qfl to the low-pressure fuel supply system is determined reflecting the fuel injection quantity from intake manifold injector 120, specifically DI ratio r.

Referring again to FIG. 4, a required supply quantity Qfh at the high-pressure fuel supply system is calculated based on the following expression (3) (step S110).

$$Qfh=kp\cdot\mathrm{Neg} \quad (3)$$

In expression (3), kp represents a constant that is shown by a product of the volumetric capacity of high-pressure pump chamber 230 (FIG. 2) and the number of times of fuel discharge from high-pressure fuel pump 200 per engine revolution.

Figure 6:
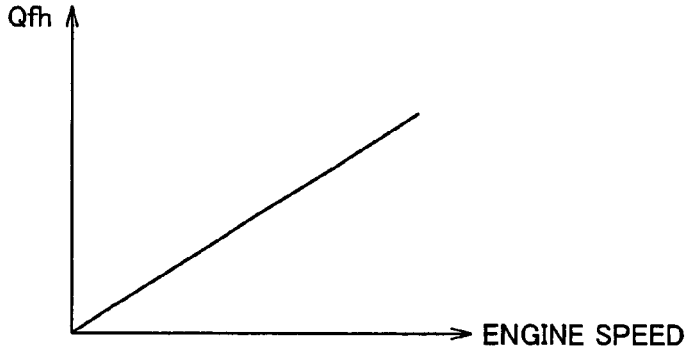
FIG. 6 is a conceptual diagram illustrating an expression for calculating a required supply quantity to a high-pressure fuel supply system.

High-pressure fuel pump 200 is the pump of an engine driven type that is driven along with the revolution of engine 10. Thus, required supply quantity Qfh at the high-pressure fuel supply system corresponds to the flow rate with which intake failure of high-pressure fuel pump 200 will not occur. That is, required supply quantity Qfh does not depend on the fuel injection quantity, but is proportional to the engine speed as shown in FIG. 6.

Further, a set flow rate (discharge quantity) Qp of low-pressure fuel pump 170 is determined in accordance with the sum of required supply quantity Qfl at the low-pressure fuel supply system obtained in step S100 and required supply quantity Qfh at the high-pressure fuel supply system obtained in step S110 (step S120). In response thereto, engine ECU 300 transmits a control signal to low-pressure fuel pump 170 to make it discharge the fuel at the set flow rate Qp.

In the flowchart shown in FIG. 4, step S100, step S110 and step S120 correspond respectively to the "first calculating means", the "second calculating means" and the "third calculating means" of the present invention.

As described above, in the flow rate setting control of the low-pressure fuel pump according to the first embodiment of the present invention, the required supply quantities to the low-pressure fuel supply system and the high-pressure fuel supply system are calculated in accordance with the operation conditions of engine 10, and the flow rate of the low-pressure fuel pump is set in accordance with their sum. Therefore, it is possible to prevent insufficient fuel supply to the respective fuel injection systems, and avoid an increase of power consumption in low-pressure fuel pump 170 due to excessive fuel supply, to thereby improve fuel efficiency. Further, the required supply quantities to the low-pressure fuel supply system and the high-pressure fuel supply system can readily be calculated using the expressions (1) and (3), respectively.

Particularly, required supply quantity Qfl at the low-pressure fuel supply system is calculated reflecting DI ratio r. Thus, it is possible to appropriately set the flow rate of low-pressure fuel pump 170 in association with the DI ratio control according to the operation state. As such, in the engine system having both the in-cylinder injectors and the intake manifold injectors as shown in FIG. 1, excessive fuel supply by low-pressure fuel pump 170 can be prevented appropriately, and thus, fuel efficiency is improved.

Figure 7A:
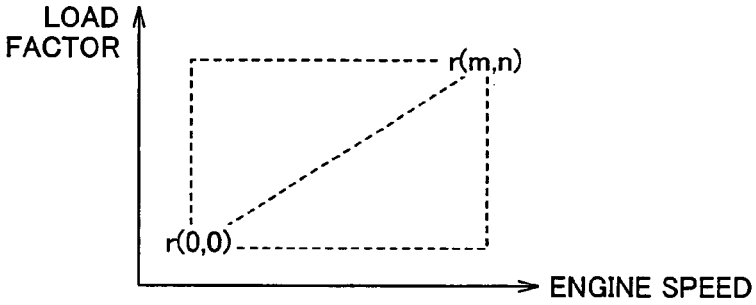
FIGS. 7A-7C are conceptual diagrams each illustrating a configuration of a map concerning the flow rate setting control of the low-pressure fuel pump according to the first embodiment of the present invention.

For setting DI ratio r, a two-dimensional map of engine speed and load factor, as shown in FIG. 7A, is referred to, and DI ratio r is selectively set from map values r (0, 0) to r (m, n) in accordance with the operation conditions of engine 10 at that time point.

Figure 7B:
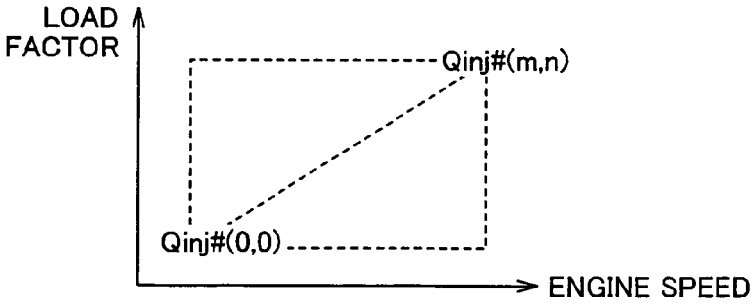

Similarly, total fuel injection quantity Qinj# is selectively set in accordance with the operation conditions of engine 10 at that time point, from map values Qinj# (0, 0) to Qinj# (m, n) on a two-dimensional map of engine speed and load factor as shown in FIG. 7B.

Figure 7C:
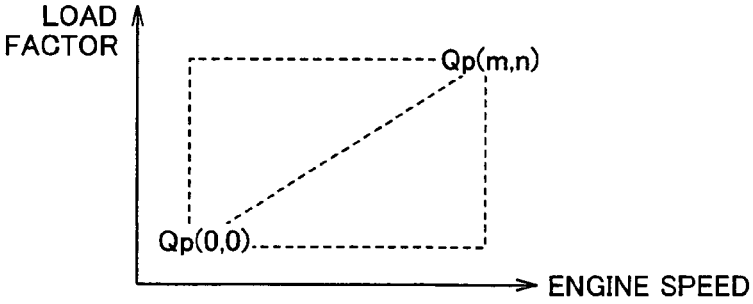

The maps of FIGS. 7A and 7B may be combined to generate a two-dimensional map of engine speed and load factor concerning the required supply quantity Qfl at the low-pressure fuel supply system indicated by the expression (1). Similarly, a map related to the engine speed can be generated for the required supply quantity Qfh at the high-pressure fuel supply system. Thus, as shown in FIG. 7C, the two-dimensional map of engine speed and load factor can be generated for flow rate Qp of the low-pressure fuel pump by combining the processes in steps S100 to S120. That is, flow rate Qp of the low-pressure fuel pump may be set by referring to the map shown in FIG. 7C and by making selection from map values Qp (0, 0) to Qp (m, n) in accordance with the operation conditions (engine speed and load factor) of engine 10 at that time point. When taking into consideration the operational load of engine ECU 300, it is preferable to perform the flow rate setting of the low-pressure fuel pump by referring to the map as shown in FIG. 7C.

Preferable DI Ratio Setting

Hereinafter, preferable setting of the DI ratio in accordance with the operation state of engine 10 in the engine system shown in FIG. 1 will be described.

Figure 8:
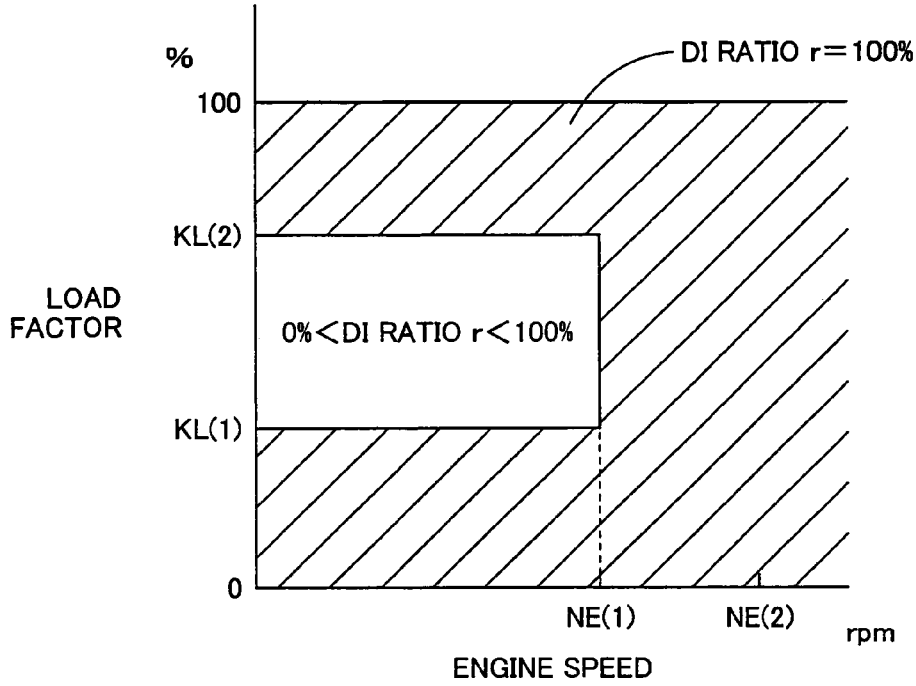
FIGS. 8 and 9 illustrate a first example of DI ratio setting maps in the engine warm state and the engine cold state, respectively, in the engine system shown in FIG. 1.
Figure 9:
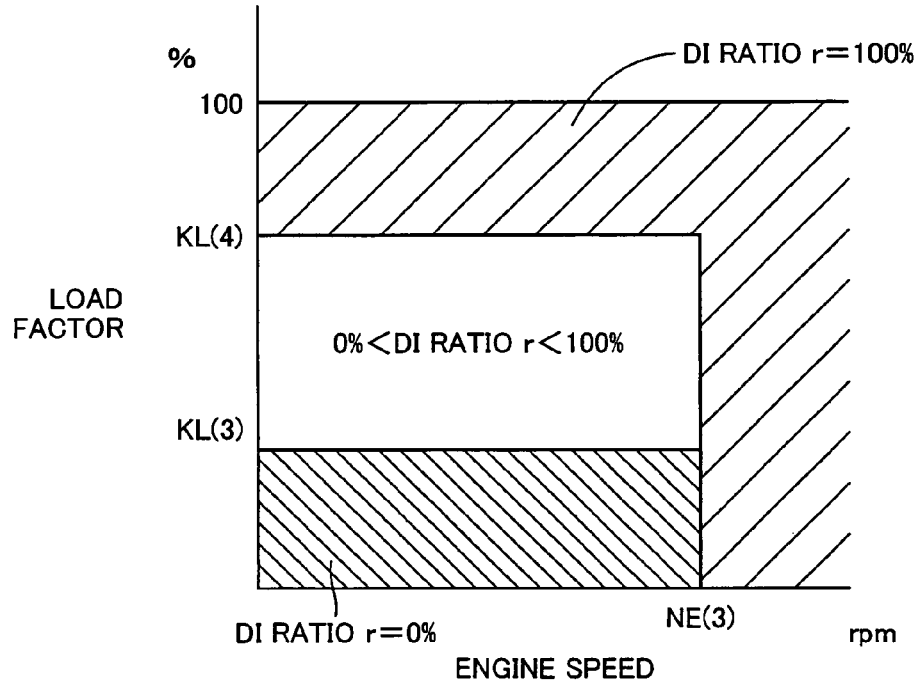

FIGS. 8 and 9 illustrate a first example of DI ratio setting maps in the engine system shown in FIG. 1.

The maps shown in FIGS. 8 and 9 are stored in ROM 320 of engine ECU 300. FIG. 8 is the map for a warm state of engine 10, and FIG. 9 is the map for a cold state of engine 10.

In the maps illustrated in FIGS. 8 and 9, with the horizontal axis representing an engine speed of engine 10 and the vertical axis representing a load factor, the fuel injection ratio of in-cylinder injector 110, or DI ratio r, is expressed in percentage.

As shown in FIGS. 8 and 9, DI ratio r is defined for each operation region that is determined by the engine speed and the load factor of engine 10, individually in the map for the warm state and the map for the cold state. The maps are configured to indicate different control regions of in-cylinder injector 110 and intake manifold injector 120 as the temperature of engine 10 changes. When the temperature of engine 10 detected is equal to or higher than a predetermined temperature threshold value, the map for the warm state shown in FIG. 8 is selected; otherwise, the map for the cold state shown in FIG. 9 is selected. One or both of in-cylinder injector 110 and intake manifold injector 120 are controlled based on the selected map and according to the engine speed and the load factor of engine 10.

The engine speed and the load factor of engine 10 set in FIGS. 8 and 9 will now be described. In FIG. 8, NE(1) is set to 2500 rpm to 2700 rpm, KL(1) is set to 30% to 50%, and KL(2) is set to 60% to 90%. In FIG. 9, NE(3) is set to 2900 rpm to 3100 rpm. That is, NE(1)<NE(3). NE(2) in FIG. 8 as well as KL(3) and KL(4) in FIG. 9 are also set as appropriate.

When comparing FIG. 8 and FIG. 9, NE(3) of the map for the cold state shown in FIG. 9 is greater than NE(1) of the map for the warm state shown in FIG. 8. This shows that, as the temperature of engine 10 is lower, the control region of intake manifold injector 120 is expanded to include the region of higher engine speed. That is, in the case where engine 10 is cold, deposits are unlikely to accumulate in the injection hole of in-cylinder injector 110 (even if the fuel is not injected from in-cylinder injector 110). Thus, the region where the fuel injection is to be carried out using intake manifold injector 120 can be expanded, to thereby improve homogeneity.

When comparing FIG. 8 and FIG. 9, "DI RATIO r=100%" holds in the region where the engine speed of engine 10 is NE(1) or higher in the map for the warm state, and in the region where the engine speed is NE(3) or higher in the map for the cold state. In terms of load factor, "DI RATIO r=100%" holds in the region where the load factor is KL(2) or greater in the map for the warm state, and in the region where the load factor is KL(4) or greater in the map for the cold state. This means that in-cylinder injector 110 alone is used in the region of a predetermined high engine speed, as well as in the region of a predetermined high engine load. That is, in the high speed region or the high load region, even if fuel injection is carried out using only in-cylinder injector 110, the engine speed and the load of engine 10 are high, ensuring a sufficient intake air quantity, so that it is readily possible to obtain a homogeneous air-fuel mixture using in-cylinder injector 110 alone. In this manner, the fuel injected from in-cylinder injector 110 is atomized within the combustion chamber involving latent heat of vaporization (or, absorbing heat from the combustion chamber). Thus, the temperature of the air-fuel mixture is decreased at the compression end, whereby antiknock performance is improved. Further, since the temperature within the combustion chamber is decreased, intake efficiency improves, leading to high power output.

In the map for the warm state in FIG. 8, fuel injection is also carried out using only in-cylinder injector 110 when the load factor is KL(1) or less. This shows that in-cylinder injector 110 alone is used in a predetermined low load region when the temperature of engine 10 is high. When engine 10 is in the warm state, deposits are likely to accumulate in the injection hole of in-cylinder injector 110. However, when fuel injection is carried out using in-cylinder injector 110, the temperature of the injection hole can be lowered, whereby accumulation of deposits is prevented. Further, clogging of in-cylinder injector 110 may be prevented while ensuring the minimum fuel injection quantity thereof Thus, in-cylinder injector 110 alone is used in the relevant region.

When comparing FIG. 8 and FIG. 9, there is a region of "DI RATIO r=0%" only in the map for the cold state in FIG. 9. This shows that fuel injection is carried out using only intake manifold injector 120 in a predetermined low load region (KL(3) or less) when the temperature of engine 10 is low. When engine 10 is cold and low in load and the intake air quantity is small, atomization of the fuel is unlikely to occur. In such a region, it is difficult to ensure favorable combustion with the fuel injection from in-cylinder injector 110. Further, particularly in the low-load and low-speed region, high power output using in-cylinder injector 110 is unnecessary. Accordingly, fuel injection is carried out using intake manifold injector 120 alone, rather than using in-cylinder injector 110, in the relevant region.

Further, in an operation other than the normal operation, i.e., in the catalyst warm-up state at idle of engine 10 (abnormal operation state), in-cylinder injector 110 is controlled to carry out stratified charge combustion. By causing the stratified charge combustion during the catalyst warm-up operation, warming up of the catalyst is promoted, and exhaust emission is thus improved.

Figure 10:
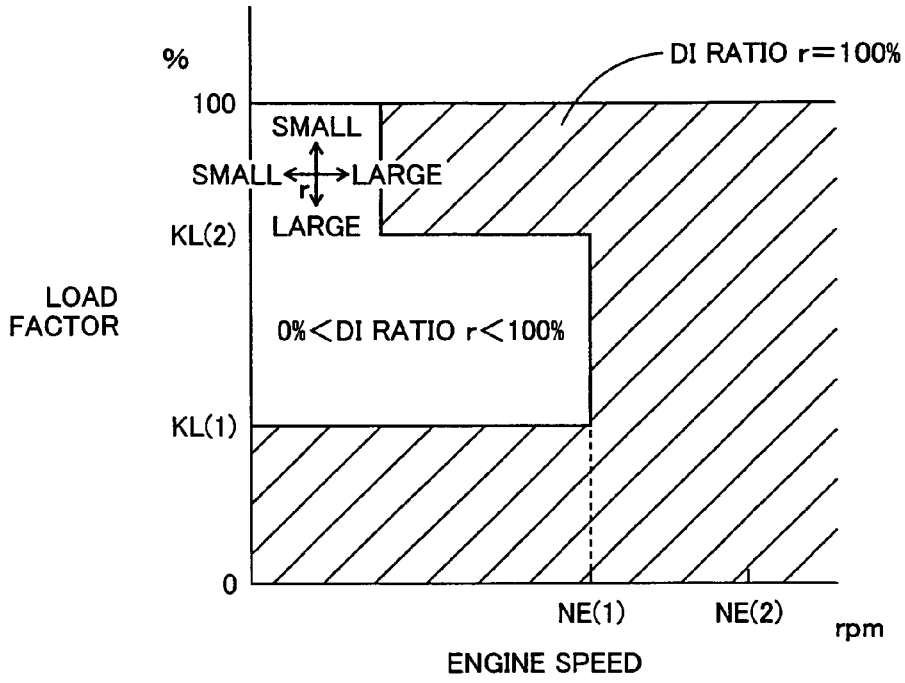
FIGS. 10 and 11 illustrate a second example of the DI ratio setting maps in the engine warm state and the engine cold state, respectively, in the engine system shown in FIG. 1.
Figure 11:
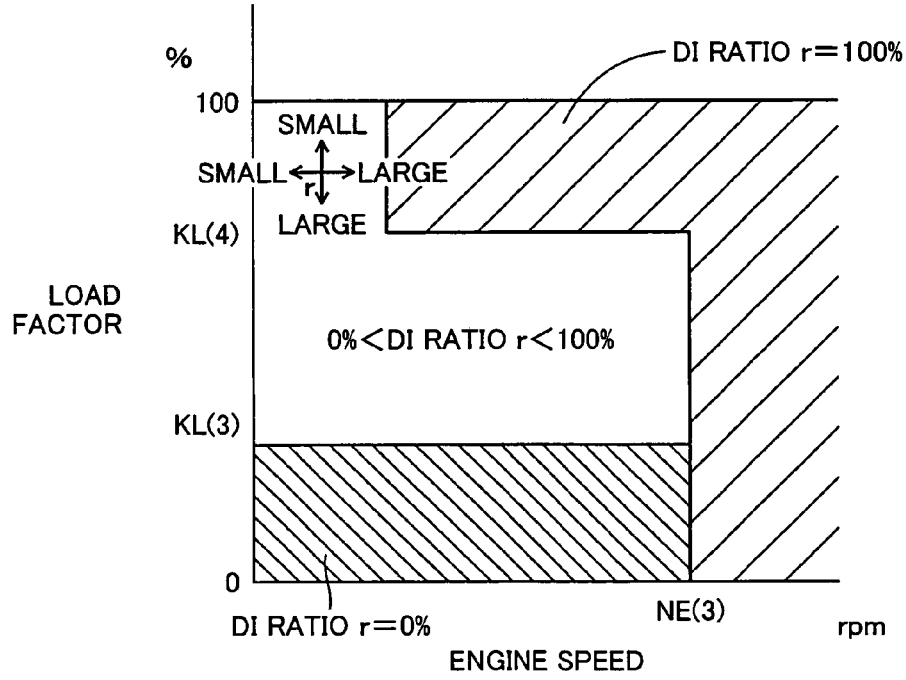

FIGS. 10 and 11 show a second example of the DI ratio setting maps in the engine system shown in FIG. 1.

The setting maps shown in FIG. 10 (warm state) and FIG. 11 (cold state) differ from those of FIGS. 8 and 9 in the DI ratio settings in the low-speed and high-load region.

In engine 10, in the low-speed and high-load region, mixing of an air-fuel mixture formed by the fuel injected from in-cylinder injector 110 is poor, and such inhomogeneous air-fuel mixture within the combustion chamber may lead to unstable combustion. Thus, the fuel injection ratio of in-cylinder injector 110 is increased as the engine speed approaches the high-speed region where such a problem is unlikely to occur, whereas the fuel injection ratio of in-cylinder injector 110 is decreased as the engine load approaches the high-load region where such a problem is likely to occur. These changes in DI ratio r are shown by crisscross arrows in FIGS. 10 and 11.

In this manner, variation in output torque of the engine attributable to the unstable combustion can be suppressed. It is noted that these measures are approximately equivalent to the measures to decrease the fuel injection ratio of in-cylinder injector 110 as the state of the engine moves toward the predetermined low speed region, or to increase the fuel injection ratio of in-cylinder injector 110 as the engine state moves toward the predetermined low load region. Further, except for the relevant region (indicated by the crisscross arrows in FIGS. 10 and 11), in the region where fuel injection is carried out using only in-cylinder injector 110 (on the high speed side and on the low load side), a homogeneous air-fuel mixture is readily obtained even when the fuel injection is carried out using only in-cylinder injector 110. In this case, the fuel injected from in-cylinder injector 110 is atomized within the combustion chamber involving latent heat of vaporization (by absorbing heat from the combustion chamber). Accordingly, the temperature of the air-fuel mixture is decreased at the compression end, and thus, the antiknock performance improves. Further, with the temperature of the combustion chamber decreased, intake efficiency improves, leading to high power output.

DI ratio settings in the other regions in the setting maps of FIGS. 10 and 11 are similar to those of FIG. 8 (warm state) and FIG. 9 (cold state), and thus, detailed description thereof will not be repeated.

In this engine 10 explained in conjunction with FIGS. 8-11, homogeneous combustion is achieved by setting the fuel injection timing of in-cylinder injector 110 in the intake stroke, while stratified charge combustion is realized by setting it in the compression stroke. That is, when the fuel injection timing of in-cylinder injector 110 is set in the compression stroke, a rich air-fuel mixture can be established locally around the spark plug, so that a lean air-fuel mixture in the combustion chamber as a whole is ignited to realize the stratified charge combustion. Even if the fuel injection timing of in-cylinder injector 110 is set in the intake stroke, stratified charge combustion can be realized if it is possible to provide a rich air-fuel mixture locally around the spark plug.

As used herein, the stratified charge combustion includes both the stratified charge combustion and semi-stratified charge combustion. In the semi-stratified charge combustion, intake manifold injector 120 injects fuel in the intake stroke to generate a lean and homogeneous air-fuel mixture in the whole combustion chamber, and then in-cylinder injector 110 injects fuel in the compression stroke to generate a rich air-fuel mixture locally around the spark plug, so as to improve the combustion state. Such semi-stratified charge combustion is preferable in the catalyst warm-up operation for the following reasons. In the catalyst warm-up operation, it is necessary to considerably retard the ignition timing and maintain a favorable combustion state (idle state) so as to cause a high-temperature combustion gas to reach the catalyst. Further, a certain quantity of fuel needs to be supplied. If the stratified charge combustion is employed to satisfy these requirements, the quantity of the fuel will be insufficient. If the homogeneous combustion is employed, the retarded amount for the purpose of maintaining favorable combustion is small compared to the case of stratified charge combustion. For these reasons, the above-described semi-stratified charge combustion is preferably employed in the catalyst warm-up operation, although either of stratified charge combustion and semi-stratified charge combustion may be employed.

Further, in the engine explained in conjunction with FIGS. 8-11, the fuel injection timing of in-cylinder injector 110 is set in the intake stroke in a basic region corresponding to the almost entire region (here, the basic region refers to the region other than the region where semi-stratified charge combustion is carried out with fuel injection from intake manifold injector 120 in the intake stroke and fuel injection from in-cylinder injector 10 in the compression stroke, which is carried out only in the catalyst warm-up state). The fuel injection timing of in-cylinder injector 110, however, may be set temporarily in the compression stroke for the purpose of stabilizing combustion, for the following reasons.

When the fuel injection timing of in-cylinder injector 110 is set in the compression stroke, the air-fuel mixture is cooled by the injected fuel while the temperature in the cylinder is relatively high. This improves the cooling effect and, hence, the antiknock performance. Further, when the fuel injection timing of in-cylinder injector 110 is set in the compression stroke, the time from the fuel injection to the ignition is short, which ensures strong penetration of the injected fuel, so that the combustion rate increases. The improvement in antiknock performance and the increase in combustion rate can prevent variation in combustion, and thus, combustion stability is improved.

Second Embodiment

In the fuel supply apparatus according to the first embodiment, low-pressure fuel pump 170 is shared by the low-pressure fuel supply system and the high-pressure fuel supply system, and the fuel once drawn by high-pressure fuel pump 200 is discharged back to low-pressure fuel path 190 during the valve-opening period of electromagnetic spill valve 250, which may cause variation in fuel pressure in the low-pressure fuel system. Thus, in the second embodiment, a configuration capable of preventing such variation in fuel pressure in the low-pressure fuel supply system will be explained.

Figure 12:
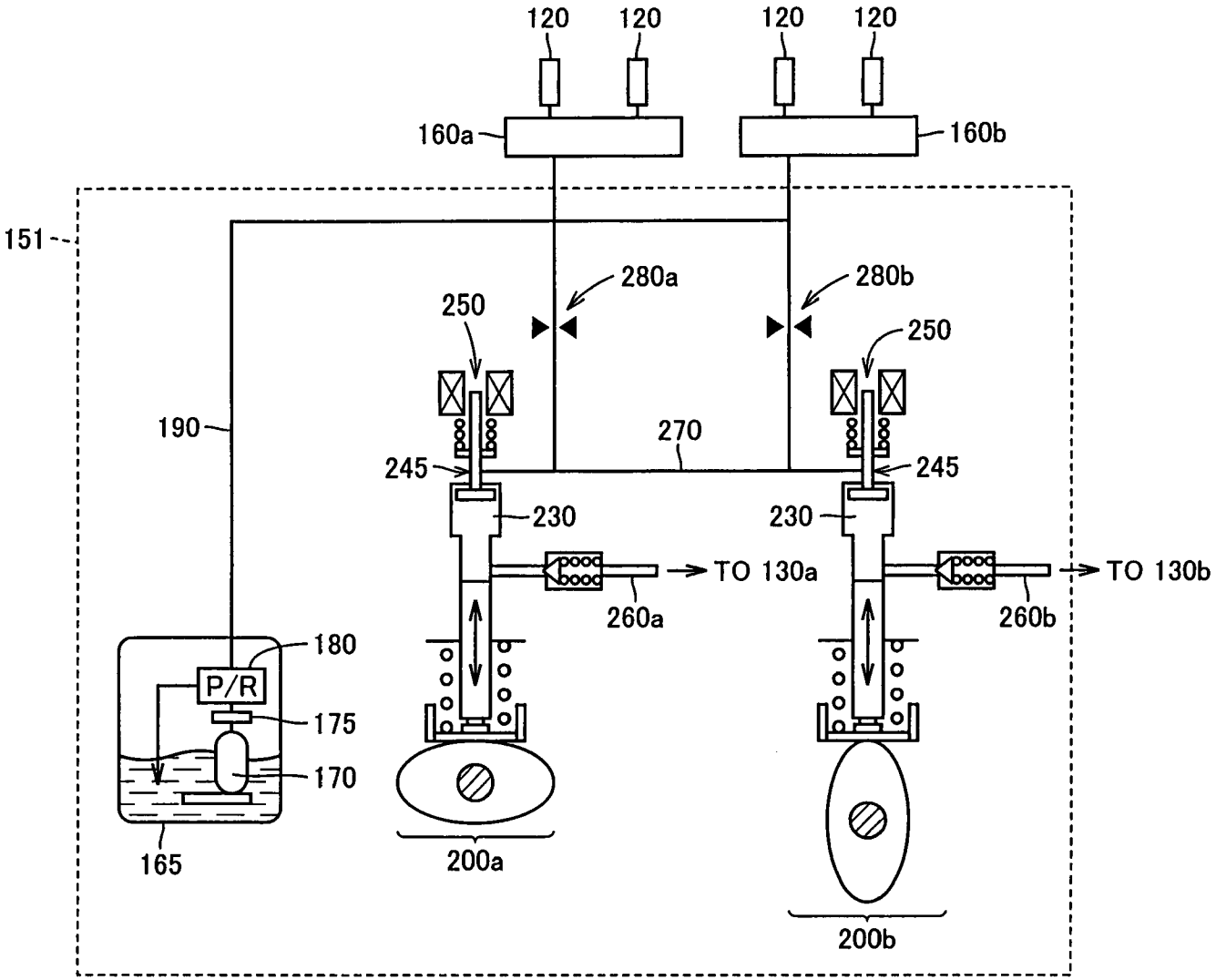
FIGS. 12 and 13 are block diagrams showing a first configuration example of a fuel supply apparatus according to a second embodiment of the present invention.
Figure 13:
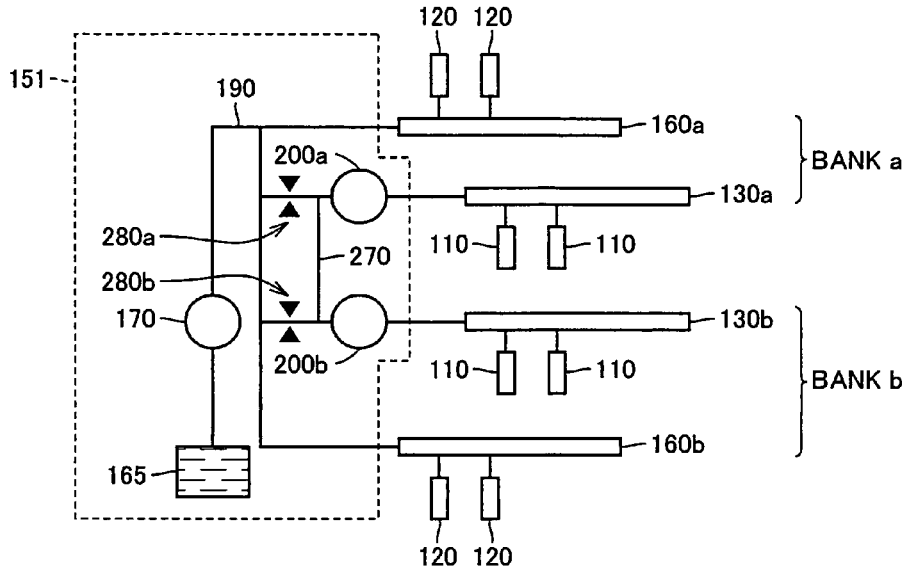

Referring to FIGS. 12 and 13, the fuel supply apparatus according to a first configuration example of the second embodiment includes a fuel supply system 151, intake manifold injectors 120 and low-pressure delivery pipes 160*a*, 160*b*, and in-cylinder injectors 110 and high-pressure delivery pipes 130*a*, 130*b*. In-cylinder injectors 110 are divided into groups and arranged in banks a and b, and intake manifold injectors 120 are also divided into groups and arranged in banks a and b. Correspondingly, high-pressure delivery pipes 130*a*, 130*b* and low-pressure delivery pipes 160*a*, 160*b* are arranged independently for the respective banks.

Further, in fuel supply system 151, high-pressure fuel pumps 200*a* and 200*b* are provided for banks a and b, respectively, independently from each other. Meanwhile, low-pressure fuel pump 170 is provided commonly for banks a and b.

High-pressure fuel pumps 200*a* and 200*b* each have the configuration and operation similar to those of high-pressure fuel pump 200 shown in FIG. 2. That is, high-pressure fuel pumps 200*a*, 200*b* each draw the fuel delivered from low-pressure fuel pump 170 via low-pressure fuel path 190 and gallery 245 into high-pressure pump chamber 230 in the intake stroke. In the discharge stroke, high-pressure fuel pumps 200*a*, 200*b* respectively deliver the pressurized fuel via high-pressure fuel paths 260*a*, 260*b* to high-pressure delivery pipes 130*a*, 130*b* during the valve-closed period of electromagnetic spill valve 250, and discharge the fuel within high-pressure pump chamber 230 back to low-pressure fuel path 190 via gallery 245 during the valve-opening period of electromagnetic spill valve 250.

In fuel supply system 151, the intake sides of high-pressure fuel pumps 200*a* and 200*b*, i.e., galleries 245 are connected by a connecting pipe 270. Further, flow rate adjusting valves 280*a* and 280*b* serving as the "flow rate regulating means" are provided in low-pressure fuel path 190, on the routes between connecting pipe 270 and low-pressure delivery pipes 160*a* and 160*b*, respectively.

When the flow rate at flow rate adjusting valves 280*a*, 280*b* is set smaller than that of connecting pipe 270, variation in pressure at connecting pipe 270 due to the fuel discharged back from high-pressure fuel pumps 200*a*, 200*b* can be prevented from being transferred to low-pressure delivery pipes 160*a*, 160*b*. Flow rate adjusting valves 280*a*, 280*b* may be replaced with small-diameter portions having the diameter smaller than that of connecting pipe 270. The flow rate of flow rate adjusting valves 280*a*, 280*b*, or the diameter of the small-diameter portions, should be set so as not to cause pressure loss with respect to the intake flow rate of high-pressure fuel pumps 200*a*, 200*b*.

Further, high-pressure fuel pumps 200*a* and 200*b* operate in opposite phases from each other. Specifically, during the discharge stroke of high-pressure fuel pump 200*a*, high-pressure fuel pump 200*b* operates in the intake stroke. Conversely, during the discharge stroke of high-pressure fuel pump 200*b*, high-pressure fuel pump 200*a* operates in the intake stroke. As such, the fuel discharged from one of the high-pressure fuel pumps to low-pressure fuel path 190 during the discharge stroke is guided via connecting pipe 270 to gallery 245 of the other high-pressure fuel pump that is in the intake stroke, without causing variation in fuel pressure with respect to low-pressure delivery pipes 160*a*, 160*b*.

As described above, in the fuel supply apparatus shown in FIGS. 12 and 13, in addition to the effects obtained by the fuel supply apparatus of the first embodiment, the fuel flowing reversely from high-pressure fuel pumps 200*a*, 200*b* to low-pressure fuel path 190 during the discharge stroke would not cause variation in fuel pressure to low-pressure delivery pipes 160*a*, 160*b*. Accordingly, it is possible to suppress variation in fuel pressure in the low-pressure supply system, to thereby stabilize fuel injection from intake manifold injectors 120.

Further, by causing high-pressure fuel pumps 200*a* and 200*b* to operate in opposite phases, the fuel (hereinafter, also referred to as "discharge-back fuel") discharged back from one high-pressure fuel pump in its discharge stroke (during the valve-opening period of electromagnetic spill valve 250) can be used as the fuel drawn into the other high-pressure fuel pump in its intake stroke.

Accordingly, the fuel supply quantity from low-pressure fuel pump 170 can be reduced by the quantity of the discharge-back fuel. The relevant quantity Qbk of the discharge-back fuel can be obtained based on the fuel injection quantity from in-cylinder injector 110 that is indicated by the product of total fuel injection quantity Qinj# and DI ratio r. Thus, by calculating required supply quantity Qfh at the high-pressure fuel supply system in accordance with the following expression (4) in step S110 of FIG. 4, the flow rate of low-pressure fuel pump 170 can be suppressed, and thus, fuel efficiency can be improved.

$$Qfh = kp \cdot \mathrm{Neg} - Qbk \quad (4)$$

Figure 14:
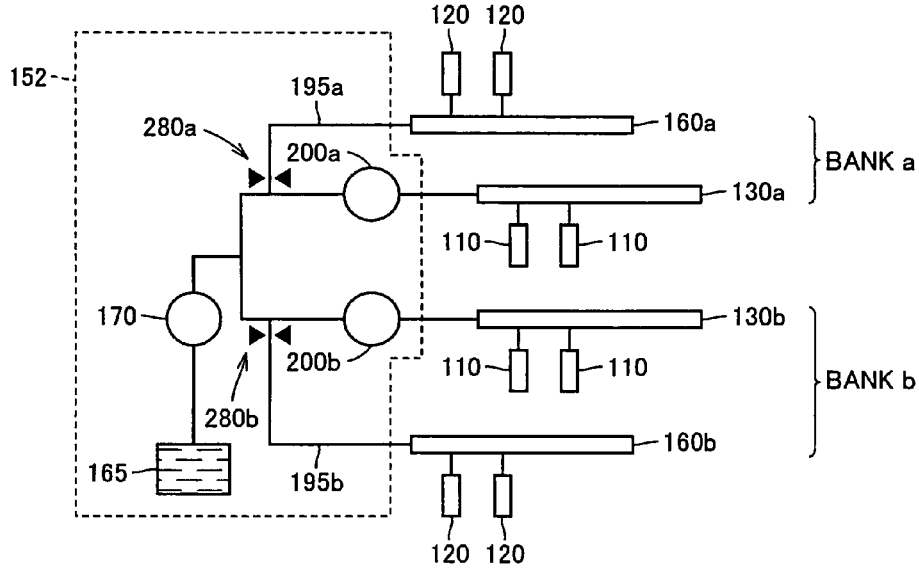
FIGS. 14 and 15 are block diagrams showing a second configuration example of the fuel supply apparatus according to the second embodiment of the present invention.
Figure 15:
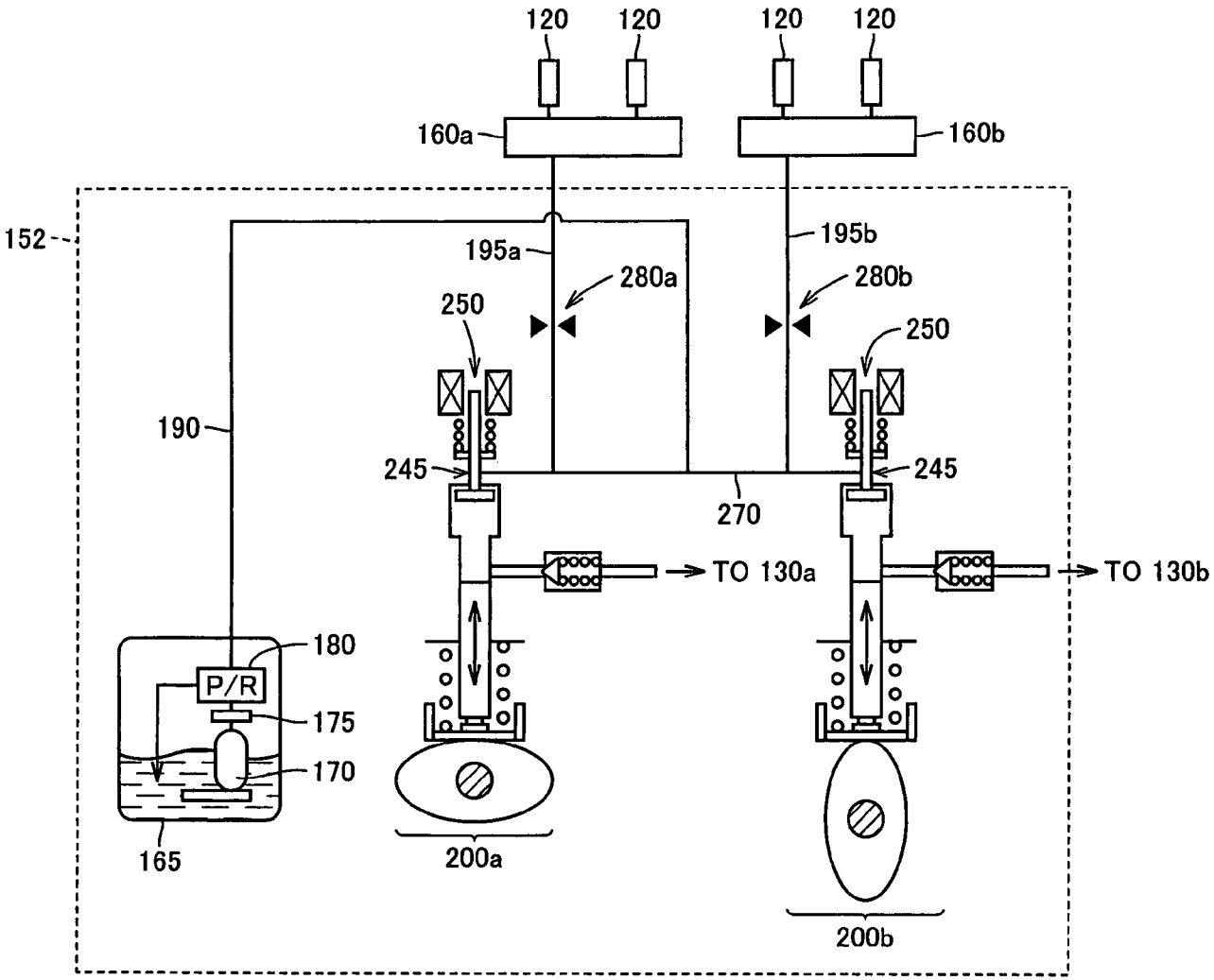

FIGS. 14 and 15 show a second configuration example of the fuel supply apparatus according to the second embodiment f the present invention.

Referring to FIGS. 14 and 15, the fuel supply apparatus according to the second configuration example of the second embodiment includes a fuel supply system 152, intake manifold injectors 120 and low-pressure delivery pipes 160*a*, 160*b*, and in-cylinder injectors 110 and high-pressure delivery pipes 130*a*, 130*b*. Fuel supply system 152 differs from fuel supply system 151 shown in FIGS. 10 and 11 in the manner of connection between low-pressure delivery pipes 160*a*, 160*b* and low-pressure fuel path 190. Otherwise, the configuration of fuel supply system 152 is similar to that of fuel supply system 151, and thus, detailed description thereof will not be repeated.

In fuel supply system 152, low-pressure fuel paths 195*a*, 195*b* between connecting pipe 270 and low-pressure delivery pipes 160*a*, 160*b* are not directly connected to low-pressure fuel path 190 receiving the discharged fuel from low-pressure fuel pump 170, but connected via flow rate adjusting valves 280*a*, 280*b* serving as the "flow rate regulating means".

Generally, the intake fuel quantity of each of high-pressure fuel pumps 200*a*, 200*b* is greater than the fuel injection quantity from intake manifold injectors 120. Thus, the pipe diameters of low-pressure fuel path 190 and connecting pipe 270 are set to be greater than those of low-pressure fuel paths 195*a*, 195*b* so as not to cause pressure loss with respect to suction of high-pressure fuel pumps 200*a*, 200*b*.

With this configuration, in fuel supply system 152 as well, the fuel reversely flowing from high-pressure fuel pumps 200*a*, 200*b* to low-pressure fuel path 190 during the discharge stroke is prevented from causing variation in fuel pressure to low-pressure delivery pipes 160*a*, 160*b*. As such, it is possible to suppress variation in fuel pressure in the low-pressure fuel supply system, to thereby stabilize fuel injection from intake manifold injectors 120.

Further, by causing high-pressure fuel pumps 200*a* and 200*b* to operate in opposite phases as in the case of fuel supply system 151, the flow rate of low-pressure fuel pump 170 can be reduced, and thus, fuel efficiency can be improved.

Figure 16:
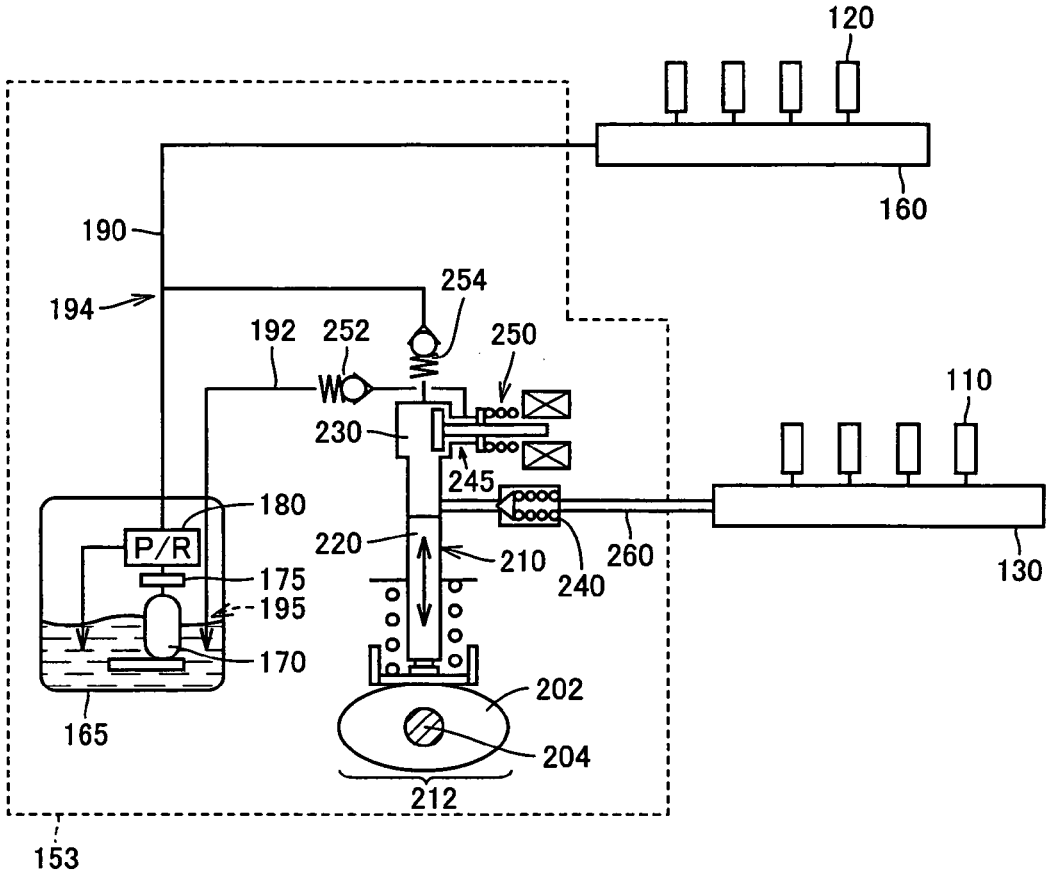
FIGS. 16-18 are block diagrams showing third to fifth configuration examples, respectively, of the fuel supply apparatus according to the second embodiment of the present invention.

FIG. 16 shows a third configuration example of the fuel supply apparatus according to the second embodiment of the present invention.

Referring to FIG. 16, the fuel supply apparatus according to the third configuration example of the second embodiment includes a fuel supply system 153, intake manifold injectors 120 and a low-pressure delivery pipe 160, and in-cylinder injectors 110 and a high-pressure delivery pipe 130.

Fuel supply system 153 differs from fuel supply system 150 shown in FIG. 2 in that it includes a high-pressure fuel pump 212 instead of high-pressure fuel pump 200. The arrangement and operations of the low-pressure fuel pump and the low-pressure fuel supply system are similar to those in fuel supply system 150, and thus, detailed description thereof will not be repeated.

In high-pressure fuel pump 212, a check valve 254 preventing reverse flow of the fuel from high-pressure pump chamber 230 to low-pressure fuel path 190 is provided on a route along which fuel is drawn from low-pressure fuel pump 170 via low-pressure fuel path 190 and a branch point 194 to high-pressure pump chamber 230. Further, a fuel discharge-back route 192 for discharging back the fuel from high-pressure pump chamber 230 via gallery 245 is provided, and a check valve 252 is provided on fuel discharge-back route 192. Fuel discharge-back route 192 is provided between high-pressure pump chamber 230 and a fuel discharge-back position 195 in low-pressure fuel path 190 that is located sufficiently far from low-pressure delivery pipe 160, so as to prevent the discharge-back fuel from causing variation in fuel pressure to low-pressure delivery pipe 160. For example, as shown in FIG. 16, fuel discharge-back route 192 is provided as the route extending from high-pressure pump chamber 230 to fuel tank 165. That is, fuel discharge-back position 195 is set in fuel tank 165. Otherwise, the configuration of high-pressure fuel pump 212 is similar to that of high-pressure fuel pump 200.

In high-pressure fuel pump 212, the fuel is drawn from low-pressure fuel path 190 to high-pressure pump chamber 230 via check valve 254 during the intake stroke. In the discharge stroke, although the fuel pressurized during the valve-closed period of the electromagnetic spill valve is delivered via check valve 240 to high-pressure fuel path 260 as in the case of high-pressure fuel pump 200, during the valve-opening period of the electromagnetic spill valve, the fuel discharged back from high-pressure pump chamber 230 is returned to fuel tank 165 via check valve 252 and fuel discharge-back route 192.

As described above, in the fuel supply apparatus shown in FIG. 16, the discharge-back fuel from high-pressure fuel pump 212 in the discharge stroke is returned to the fuel route sufficiently far from low-pressure delivery pipe 160, preferably to fuel tank 165. This can prevent occurrence of variation in fuel pressure in the low-pressure fuel supply system due to the discharge-back fuel from high-pressure fuel pump 212. Accordingly, it is possible to stabilize the fuel injection from intake manifold injectors 120.

Figure 17:
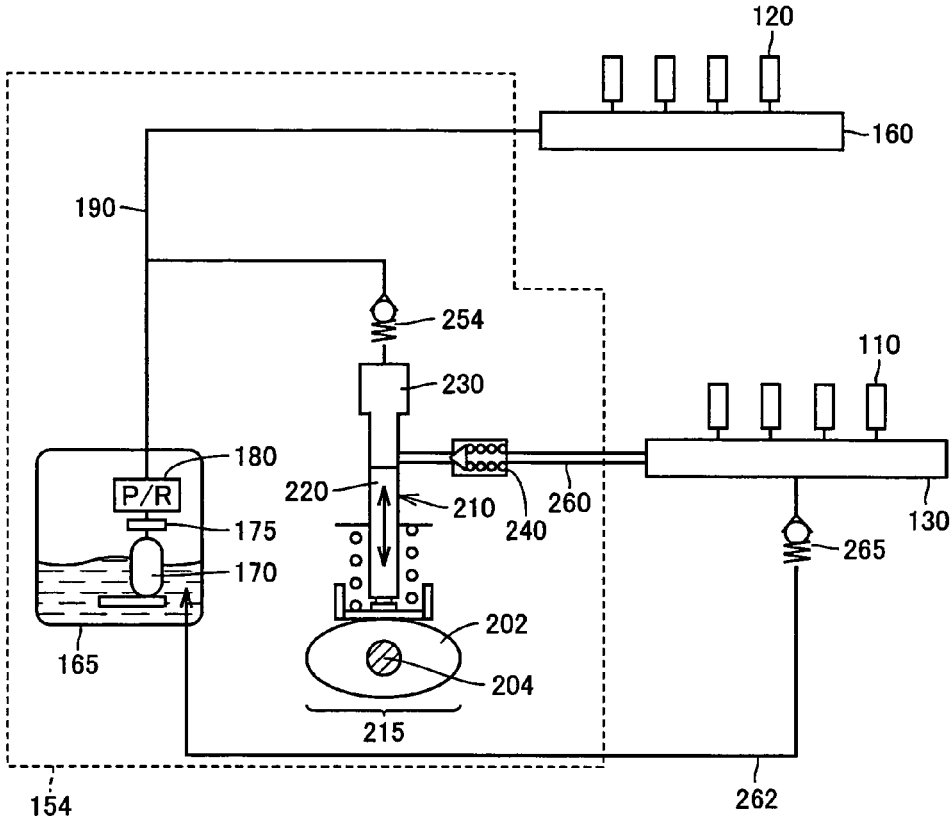

FIG. 17 is a block diagram illustrating a configuration of the fuel supply apparatus according to a fourth configuration example of the second embodiment of the present invention.

Referring to FIG. 17, the fuel supply apparatus according to the fourth configuration example of the second embodiment includes a fuel supply system 154, intake manifold injectors 120 and a low-pressure delivery pipe 160, and in-cylinder injectors 110 and a high-pressure delivery pipe 130. Fuel supply system 154 differs from fuel supply system 150 shown in FIG. 2 in that it includes a high-pressure fuel pump 215 instead of high-pressure fuel pump 200. Further, the high-pressure fuel supply system includes a fuel return route 262 from high-pressure delivery pipe 130, and a check valve 265 provided at the relevant fuel route. Check valve 265 opens when the fuel pressure within high-pressure delivery pipe 130 exceeds a prescribed level. The arrangement and operations of the low-pressure fuel pump and the low-pressure fuel supply system in fuel supply system 154 are similar to those in fuel supply system 150, and thus, detailed description thereof will not be repeated.

High-pressure fuel pump 215 differs from high-pressure fuel pump 200 in that electromagnetic spill valve 250 is not provided and in that a check valve 254 is arranged between low-pressure fuel path 190 and high-pressure pump chamber 230. Check valve 254 is arranged so as to prevent the fuel from being discharged from high-pressure pump chamber 230 back to low-pressure fuel path 190. Otherwise, the configuration of high-pressure fuel pump 215 is similar to that of high-pressure fuel pump 200.

Thus, in high-pressure fuel pump 215, the whole quantity of the fuel drawn from low-pressure fuel path 190 to high-pressure pump chamber 230 in the intake stroke is delivered to high-pressure fuel path 260 in the discharge stroke. The excess fuel supplied to high-pressure delivery pipe 130 is returned to fuel tank 165 via check valve 265 and fuel return route 262.

In fuel supply system 154, high-pressure fuel pump 215 having the configuration where the fuel is not discharged back to low-pressure fuel path 190 in the discharge stroke is employed. Thus, occurrence of variation in fuel pressure in the low-pressure fuel supply system is prevented, and accordingly, fuel injection from intake manifold injectors 120 is stabilized.

High-pressure fuel pump 215 can be simplified in configuration, since electromagnetic spill valve 155 for which open/close control in accordance with the discharge quantity would be necessary is not provided. However, since the pressurizing (compressing) operation of the fuel is carried out over the entire period of the discharge stroke, engine load becomes high, which is disadvantageous in terms of fuel efficiency.

Figure 18:
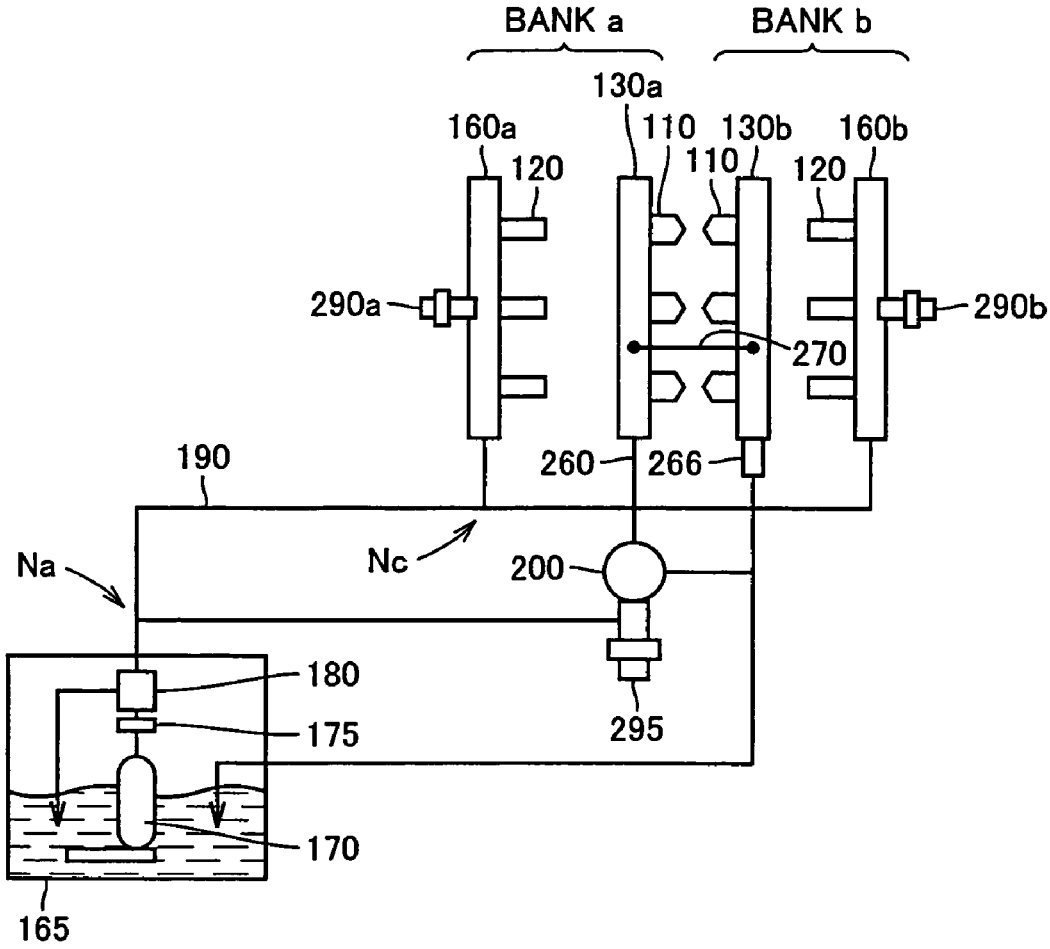

FIG. 18 is a block diagram showing a fifth configuration example of the fuel supply apparatus according to the second embodiment of the present invention.

Referring to FIG. 18, in the fuel supply apparatus according to the fifth configuration example of the second embodiment, in-cylinder injectors 110 and intake manifold injectors 120 are each divided into groups to be arranged in banks a and b. Correspondingly, high-pressure delivery pipes 130*a* and 130*b* and low-pressure delivery pipes 160*a* and 160*b* are provided for banks a and b, respectively.

Low-pressure delivery pipes 160*a* and 160*b* are branched from low-pressure fuel path 190 at a branch point Nc on low-pressure fuel path 190. A common high-pressure fuel pump 200 is provided for high-pressure delivery pipes 130*a* and 130*b*. Further, a fuel intake route from low-pressure fuel path 190 to high-pressure fuel pump 200 is branched from low-pressure fuel path 190 at a branch point Na thereon. A connecting pipe 270 is provided between high-pressure delivery pipes 130*a* and 130*b*, and a relief valve 266 is provided to form a fuel return route from high-pressure delivery pipe 130*b* to fuel tank 165.

In the fuel supply apparatus shown in FIG. 18, fuel pressure adjusting devices 290*a* and 290*b* are further provided corresponding to low-pressure delivery pipes 160*a* and 160*b*, respectively, arranged for the respective banks. Fuel pressure adjusting devices 290*a*, 290*b* may be pulsation dampers, for example. This can stabilize the fuel pressure in low-pressure delivery pipes 160*a*, 160*b*.

It is noted that the fuel pressure in low-pressure delivery pipes 160*a*, 160*b* can further be stabilized when flow rate adjusting valves 280*a*, 280*b* (not shown) similar to those in FIGS. 12-15 are provided between branch point Nc and low-pressure delivery pipes 160*a*, 160*b*.

A pulsation damper 295 is further provided at the intake side of high-pressure fuel pump 200, and the branch point Na from low-pressure fuel path 190 to the intake side of high-pressure fuel pump 200 is provided at a distance from low-pressure delivery pipes 160*a*, 160*b*. This ensures a sufficiently long route between the fuel discharge-back point from high-pressure fuel pump 200 and low-pressure delivery pipes 160*a*, 160*b*. Accordingly, variation in fuel pressure in the low-pressure fuel supply system due to the fuel discharged back from high-pressure fuel pump 200 can further be suppressed.

Figure 19:
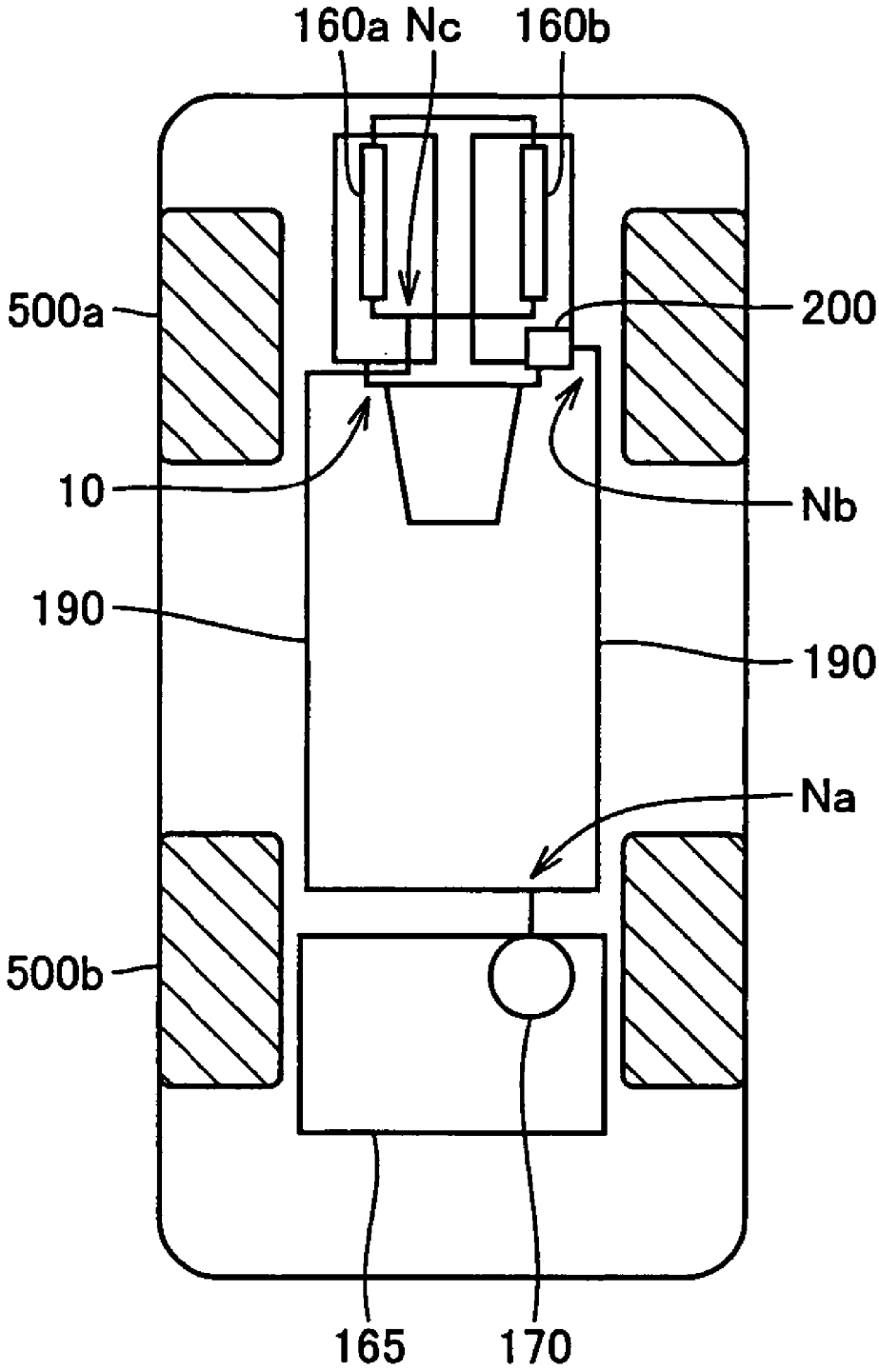
FIG. 19 illustrates a layout when mounting the fuel supply apparatus shown in FIG. 18 to a vehicle.

For example, as shown in FIG. 19, fuel tank 165 and low-pressure fuel pump 170 are provided on the side of rear wheels 500*b*, and branch point Na is provided near the outlet of fuel tank 165. High-pressure fuel pump 200 and the high-pressure fuel supply system (not shown) at the subsequent stage, and low-pressure delivery pipes 160*a*, 160*b* in the low-pressure fuel supply system are provided corresponding to engine 10 arranged near front wheels 500*a*.

As the configuration for ensuring the sufficiently long route between high-pressure fuel pump 200 and low-pressure delivery pipes 160*a*, 160*b*, the configuration of arranging the fuel pipes at both the right and left sides of the vehicle, the configuration of arranging the fuel pipes only at the right side or the left side, or the configuration of providing the pipes in a spiral manner to ensure a long pipe length while setting branch point Na near engine 10, may be applied. Alternatively, the configuration of providing an accumulator or a reservoir in the vicinity of the fuel discharge-back point from high-pressure fuel pump 200 so as to attenuate pulsation due to the discharge-back fuel may be provided to further suppress variation in fuel pressure in the low-pressure fuel supply system.

With such a configuration, in the fuel supply apparatus shown in FIGS. 18 and 19 as well, variation in fuel pressure in the low-pressure fuel supply system can be suppressed, and thus, fuel injection from intake manifold injectors 120 can be stabilized.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A fuel supply apparatus for supplying fuel to an internal combustion engine, comprising:

a first fuel pump drawing fuel from a fuel tank and discharging the fuel at a first pressure;

a first fuel supply system including first fuel injection means for injecting fuel into said internal combustion engine at said first pressure and a first fuel delivery pipe receiving the fuel discharged from said first fuel pump and delivering the fuel to said first fuel injection means;

a second fuel supply system including second fuel injection means for injecting fuel into said internal combustion engine at a second pressure that is higher than said first pressure, a second fuel pump driven by said internal combustion engine and drawing and further pressurizing the fuel discharged from said first fuel pump and discharging the fuel at said second pressure, and a second fuel delivery pipe receiving the fuel discharged from said second fuel pump and delivering the fuel to said second fuel injection means; and discharge quantity calculating means for obtaining required supply quantities to said first and second fuel supply systems, respectively, in accordance with an operation condition of the internal combustion engine and for determining a discharge quantity from said first fuel pump based on the required supply quantities obtained, wherein said discharge quantity calculating means includes first calculating means for calculating the required supply quantity to said first fuel supply system based on at least a fuel injection quantity by said first fuel injection means and the number of revolutions of said internal combustion engine, second calculating means for calculating the required supply quantity to said second fuel supply system based on the number of revolutions of said internal combustion engine without said fuel injection quantity, and third calculating means for determining the discharge quantity from said first fuel pump in accordance with a sum of the required supply quantities calculated by said first and second calculating means.

2. The fuel supply apparatus according to claim 1, wherein the required supply quantity is calculated based on an expression $$Qfh=kp\cdot Neg$$

where Qfh represents the required supply quantity, kp represents a product of a volumetric capacity of a chamber of the second fuel pump and the number of times fuel discharge from the second fuel pump per engine revolution, and Neg represents the number of revolution of the internal combustion engine.

3. The fuel supply apparatus according to claim 1, further comprising fuel injection control means for controlling a fuel injection ratio between said first fuel injection means and said second fuel injection means with respect to a total fuel injection quantity in accordance with an operation state of said internal combustion engine, wherein said first calculating means calculates the required supply quantity to said first fuel supply system by obtaining the fuel injection quantity of said first fuel injection means reflecting said fuel injection ratio controlled by said fuel injection control means.

4. The fuel supply apparatus according to claim 1, wherein a plurality of said second fuel delivery pipes are provided, said second fuel injection means are divided into groups and provided respectively for said plurality of second fuel delivery pipes, a plurality of said second fuel pumps are provided respectively for said plurality of second fuel delivery pipes, and in each of said second fuel pumps, a plunger in a cylinder is driven to move in a reciprocating manner by a cam driven to rotate by said internal combustion engine, and in an intake stroke where volumetric capacity of a pressurizing chamber delimited by the cylinder and the plunger is increased, the fuel is drawn to said pressurizing chamber from an intake side of said second fuel pump connected to a discharge side of said first fuel pump, and in a discharge stroke where the volumetric capacity of said pressurizing chamber is reduced, the fuel is discharged from said pressurizing chamber to a discharge route during a valve-closed period of a metering valve and the fuel reversely flows from said pressurizing chamber to said intake side during a valve-opening period of said metering valve, said fuel supply apparatus further comprising:

a connecting path connecting said intake sides of said plurality of second fuel pumps; and flow rate regulating means provided on a fuel route between said connecting path and said first fuel delivery pipe.

5. The fuel supply apparatus according to claim 4, wherein said second fuel pumps having said intake sides connected to each other by said connecting path are arranged such that one of said second fuel pumps operates in said intake stroke when the other of said second fuel pumps operates in said discharge stroke.

6. The fuel supply apparatus according to claim 1, wherein in said second fuel pump, a plunger in a cylinder is driven to move in a reciprocating manner by a cam driven to rotate by said internal combustion engine, and in an intake stroke where the volumetric capacity of a pressurizing chamber delimited by the cylinder and the plunger is increased, the fuel is drawn to said pressurizing chamber from an intake side of said second fuel pump that is connected to a discharge side of said first fuel pump via a branch point, and in a discharge stroke where the volumetric capacity of said pressurizing chamber is reduced, the fuel is discharged from said pressurizing chamber to a discharge route during a valve-closed period of a metering valve and the fuel reversely flows from said pressurizing chamber to said intake side during a valve-opening period of said metering valve, said fuel supply apparatus further comprising fuel discharge-back means for guiding the fuel reversely flowing from said pressurizing chamber to said intake side in said second fuel pump in said discharge stroke to a fuel discharge-back position provided in said first fuel supply system, wherein said branch point is arranged at a position farther from said fuel tank than at least said fuel discharge-back position.

7. The fuel supply apparatus according to claim 1, wherein in said second fuel pump, a plunger in a cylinder is driven to move in a reciprocating manner by a cam driven to rotate by said internal combustion engine, and in an intake stroke where the volumetric capacity of a pressurizing chamber delimited by the cylinder and the plunger is increased, the fuel is drawn to said pressurizing chamber from an intake side of said second fuel pump connected to a discharge side of said first fuel pump, and in a discharge stroke where the volumetric capacity of said pressurizing chamber is reduced, the pressurized fuel is discharged from said pressurizing chamber to a discharge route, said fuel supply apparatus further comprising fuel return means actuated when a fuel pressure in said second fuel delivery pipe exceeds a prescribed level, for forming a fuel return route from said second fuel delivery pipe to said fuel tank.

8. The fuel supply apparatus according to claim 1, wherein a plurality of said first fuel delivery pipes are provided, said first fuel injection means are divided into groups and provided respectively for said plurality of first fuel delivery pipes, and said first fuel pump is commonly provided for said plurality of first fuel delivery pipes, said fuel supply apparatus further comprising pressure adjusting devices provided respectively for said plurality of first fuel delivery pipes.

9. A fuel supply apparatus for supplying fuel to an internal combustion engine, comprising:

a first fuel pump drawing fuel from a fuel tank and discharging the fuel at a first pressure;

a first fuel supply system including first fuel injection mechanisms for injecting fuel into said internal combustion engine at said first pressure and a first fuel delivery pipe receiving the fuel discharged from said first fuel pump and delivering the fuel to said first fuel injection mechanisms;

a second fuel supply system including second fuel injection mechanisms for injecting fuel into said internal combustion engine at a second pressure that is higher than said first pressure, a second fuel pump driven by said internal combustion engine and drawing and further pressurizing the fuel discharged from said first fuel pump and discharging the fuel at said second pressure, and a second fuel delivery pipe receiving the fuel discharged from said second fuel pump and delivering the fuel to said second fuel injection mechanisms; and a discharge quantity calculating portion for obtaining required supply quantities to said first and second fuel supply systems, respectively, in accordance with an operation condition of the internal combustion engine and for determining a discharge quantity from said first fuel pump based on the required supply quantities obtained, wherein said discharge quantity calculating portion includes a first calculating portion for calculating the required supply quantity to said first fuel supply system based on at least a fuel injection quantity by said first fuel injection mechanisms and the number of revolutions of said internal combustion engine, second calculating portion for calculating the required supply quantity to said second fuel supply system based on the number of revolutions of said internal combustion engine without said fuel injection quantity, and third calculating portion for determining the discharge quantity from said first fuel pump in accordance with a sum of the required supply quantities calculated by said first and second calculating portions.

10. The fuel supply apparatus according to claim 9, wherein the required supply quantity is calculated based on an expression $$Qth = kp \cdot \mathrm{Neg}$$

where Qfh represents the required supply quantity, kp represents a product of a volumetric capacity of a chamber of the second fuel pump and the number of times fuel discharge from the second fuel pump per engine revolution, and Neg represents the number of revolution of the internal combustion engine.

11. The fuel supply apparatus according to claim 9, further comprising a fuel injection control unit for controlling a fuel injection ratio between said first fuel injection mechanisms and said second fuel injection mechanisms with respect to a total fuel injection quantity in accordance with an operation state of said internal combustion engine, wherein said first calculating portion calculates the required supply quantity to said first fuel supply system by obtaining the fuel injection quantity of said first fuel injection mechanisms reflecting said fuel injection ratio controlled by said fuel injection control unit.

12. The fuel supply apparatus according to claim 9, wherein a plurality of said second fuel delivery pipes are provided, said second fuel injection mechanisms are divided into groups and provided respectively for said plurality of second fuel delivery pipes, a plurality of said second fuel pumps are provided respectively for said second fuel delivery pipes, and in each of said second fuel pumps, a plunger in a cylinder is driven to move in a reciprocating manner by a cam driven to rotate by said internal combustion engine, and in an intake stroke where volumetric capacity of a pressurizing chamber delimited by the cylinder and the plunger is increased, the fuel is drawn to said pressurizing chamber from an intake side of said second fuel pump connected to a discharge side of said first fuel pump, and in a discharge stroke where the volumetric capacity of said pressurizing chamber is reduced, the fuel is discharged from said pressurizing chamber to a discharge route during a valve-closed period of a metering valve and the fuel reversely flows from said pressurizing chamber to said intake side during a valve-opening period of said metering valve, said fuel supply apparatus further comprising:

a connecting path connecting said intake sides of said plurality of second fuel pumps; and a flow rate regulating unit provided on a fuel route between said connecting path and said first fuel delivery pipe.

13. The fuel supply apparatus according to claim 12, wherein said second fuel pumps having said intake sides connected to each other by said connecting path are arranged such that one of said second fuel pumps operates in said intake stroke when the other of said second fuel pumps operates in said discharge stroke.

14. The fuel supply apparatus according to claim 9, wherein in said second fuel pump, a plunger in a cylinder is driven to move in a reciprocating manner by a cam driven to rotate by said internal combustion engine, and in an intake stroke where the volumetric capacity of a pressurizing chamber delimited by the cylinder and the plunger is increased, the fuel is drawn to said pressurizing chamber from an intake side of said second fuel pump that is connected to a discharge side of said first fuel pump via a branch point, and in a discharge stroke where the volumetric capacity of said pressurizing chamber is reduced, the fuel is discharged from said pressurizing chamber to a discharge route during a valve-closed period of a metering valve and the fuel reversely flows from said pressurizing chamber to said intake side during a valve-opening period of said metering valve, said fuel supply apparatus further comprising a fuel discharge-back unit for guiding the fuel reversely flowing from said pressurizing chamber to said intake side in said second fuel pump in said discharge stroke to a fuel discharge-back position provided in said first fuel supply system, wherein said branch point is arranged at a position farther from said fuel tank than at least said fuel discharge-back position.

15. The fuel supply apparatus according to claim 9, wherein in said second fuel pump, a plunger in a cylinder is driven to move in a reciprocating manner by a cam driven to rotate by said internal combustion engine, and in an intake stroke where the volumetric capacity of a pressurizing chamber delimited by the cylinder and the plunger is increased, the fuel is drawn to said pressurizing chamber from an intake side of said second fuel pump connected to a discharge side of said first fuel pump, and in a discharge stroke where the volumetric capacity of said pressurizing chamber is reduced, the pressurized fuel is discharged from said pressurizing chamber to a discharge route, said fuel supply apparatus further comprising a fuel return unit actuated when a fuel pressure in said second fuel delivery pipe exceeds a prescribed level, and forming a fuel return route from said second fuel delivery pipe to said fuel tank.

16. The fuel supply apparatus according to claim 9, wherein a plurality of said first fuel delivery pipes are provided, said first fuel injection mechanisms are divided into groups and provided respectively for said plurality of first fuel delivery pipes, and said first fuel pump is commonly provided for said plurality of first fuel delivery pipes, said fuel supply apparatus further comprising pressure adjusting devices provided respectively for said plurality of first fuel delivery pipes.

* * * * *